US011058183B2

(12) United States Patent
Beers et al.

(10) Patent No.: US 11,058,183 B2
(45) **Date of Patent: *Jul. 13, 2021**

(54) ARTICLE OF FOOTWEAR COMPRISING MOTORIZED TENSIONING DEVICE WITH SPLIT SPOOL SYSTEM

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/531,340

(22) Filed: Aug. 5, 2019

(65) Prior Publication Data

US 2020/0000179 A1 Jan. 2, 2020

Related U.S. Application Data

(63) Continuation of application No. 15/577,806, filed as application No. PCT/US2016/032249 on May 13, 2016, now Pat. No. 10,405,610.

(60) Provisional application No. 62/168,055, filed on May 29, 2015.

(51) Int. Cl.

| | |
|---|---|
| ***A43C 7/00*** | (2006.01) |
| ***A43C 11/16*** | (2006.01) |
| ***A43B 3/00*** | (2006.01) |
| ***A43C 1/00*** | (2006.01) |
| ***A43B 11/00*** | (2006.01) |
| ***A43C 7/08*** | (2006.01) |

(52) U.S. Cl.

CPC ..... *A43C 11/165* (2013.01); *A43B 3/0005* (2013.01); *A43B 11/00* (2013.01); *A43C 1/003* (2013.01); *A43C 7/08* (2013.01)

(58) Field of Classification Search

CPC ..... A43C 11/008; A43C 11/165; A43C 7/08; A43B 3/0005; A43B 7/1495

USPC ..... 36/50.1, 50.5

See application file for complete search history.

(56) References Cited

U.S. PATENT DOCUMENTS

| | | | |
|---|---|---|---|
| 4,724,626 | A | 2/1988 | Baggio |
| 5,205,055 | A | 4/1993 | Harrell |
| 5,839,210 | A | 11/1998 | Bernier et al. |

(Continued)

FOREIGN PATENT DOCUMENTS

| | | | |
|---|---|---|---|
| CN | 1172621 | A | 2/1998 |
| CN | 107847016 | A | 3/2018 |

(Continued)

OTHER PUBLICATIONS

"U.S. Appl. No. 15/577,806, Notice of Allowance dated May 1, 2019", 7 pgs.

(Continued)

*Primary Examiner* — Marie D Bays

(74) *Attorney, Agent, or Firm* — Schwegman Lundberg & Woessner, P.A.

(57) ABSTRACT

A tensioning system for articles of footwear and articles of apparel is disclosed. The tensioning system includes a tensioning member that is tightened or loosened using a motorized tensioning device for winding and unwinding the tensioning member on a spool. The motorized tensioning device includes a torque transmitting system that allows for incremental tightening, incremental loosening and full loosening of the tensioning member.

18 Claims, 15 Drawing Sheets

(56) References Cited

U.S. PATENT DOCUMENTS

| | | | | |
|---|---|---|---|---|
| 5,934,599 | A | 8/1999 | Hammerslag | |
| 6,032,387 | A | 3/2000 | Johnson | |
| 7,752,774 | B2 | 7/2010 | Ussher | |
| 7,992,261 | B2 | 8/2011 | Hammerslag et al. | |
| 8,046,937 | B2 | 11/2011 | Beers et al. | |
| 9,861,164 | B2 | 1/2018 | Beers et al. | |
| 10,201,212 | B2 | 2/2019 | Beers et al. | |
| 10,238,180 | B2 | 3/2019 | Beers et al. | |
| 10,405,610 | B2 * | 9/2019 | Beers | A43C 1/003 |
| 2003/0150135 | A1 | 8/2003 | Liu | |
| 2004/0134099 | A1 | 7/2004 | Jones et al. | |
| 2005/0198867 | A1 | 9/2005 | Labbe | |
| 2008/0010854 | A1 | 1/2008 | Sokolowski | |
| 2014/0082963 | A1 | 3/2014 | Beers | |
| 2015/0013184 | A1 | 1/2015 | Beers | |
| 2015/0047230 | A1 | 2/2015 | Beers | |
| 2017/0265572 | A1 | 9/2017 | Beers et al. | |
| 2017/0265573 | A1 | 9/2017 | Beers et al. | |
| 2017/0265575 | A1 | 9/2017 | Beers et al. | |
| 2017/0265576 | A1 | 9/2017 | Beers et al. | |
| 2017/0265585 | A1 | 9/2017 | Orand | |
| 2018/0125168 | A1 | 5/2018 | Beers et al. | |
| 2018/0153263 | A1 | 6/2018 | Beers et al. | |
| 2019/0098963 | A1 | 4/2019 | Beers et al. | |

FOREIGN PATENT DOCUMENTS

| | | | |
|---|---|---|---|
| DE | 29817003 | U1 | 3/1999 |
| EP | 2796064 | A1 | 10/2014 |
| EP | 3302156 | B1 | 7/2020 |
| GB | 2449722 | A | 12/2008 |
| JP | 2018516673 | A | 6/2018 |
| WO | WO-2009071652 | A1 | 6/2009 |
| WO | WO-2016195965 | A1 | 12/2016 |

OTHER PUBLICATIONS

"European Application Serial No. 16728442.1, Response filed Jul. 19, 2018 to Communication Pursuant to Rules 161(2) and 162 dated Jan. 19, 2018", 13 pgs.

"International Application Serial No. PCT/US2016/032249, International Preliminary Report on Patentability dated Dec. 14, 2017", 10 pgs.

"International Application Serial No. PCT/US2016/032249, International Search Report dated Sep. 23, 2016", 7 pgs.

"International Application Serial No. PCT/US2016/032249, Written Opinion dated Sep. 23, 2016", 8 pgs.

"Chinese Application Serial No. 201680043679X, Office Action dated Dec. 30, 2019", w/o English translation, 7 pgs.

"Chinese Application Serial No. 201680043679X, Response filed Jul. 14, 2020 to Office Action dated Dec. 30, 2019", w/ English claims, 40 pgs.

"European Application Serial No. 20182965.2, Extended European Search Report dated Feb. 1, 2021", 18 pgs.

"European Application Serial No. 20182965.2, Partial European Search Report dated Oct. 27, 2020", 20 pgs.

"Japanese Application Serial No. 2017-561887, Notification of Reasons for Refusal dated Aug. 25, 2020", w/ English translation, 10 pgs.

* cited by examiner

ARTICLE OF FOOTWEAR COMPRISING MOTORIZED TENSIONING DEVICE WITH SPLIT SPOOL SYSTEM

The present embodiments relate generally to articles of footwear and apparel including tensioning systems.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, an article of footwear comprises an upper, a sole structure attached to the upper, the sole structure includes a midfoot region. The midfoot region includes a motorized tensioning device fixedly attached. The motorized tensioning device including a motor assembly coupled to a shaft member by a gear reduction system. The gear reduction system includes a first gear member intermeshed with a second gear member. The motor assembly actuates the gear reduction system when the motorized tensioning device is activated. The gear reduction system enables the first gear to transfer motion to the second gear in a first rotational direction when the motorized tensioning device is activated. Wherein the gear reduction system prevents the second gear from transferring motion to the first gear.

In another aspect, an article of footwear comprises an upper, a sole structure attached the upper, the sole structure includes a midfoot region. The midfoot region includes a motorized tensioning device fixedly attached. The motorized tensioning device includes a first reel member and a first lace member attached to the first reel member and the motorized tensioning device includes a second reel member and a second lace member attached to the second reel member. The first lace member and the second lace member are routed from the first reel member and the second reel member through sidewall portions disposed on a medial side and a lateral side of the upper such that portions of the first lace member and the second lace member are arranged in a parallel configuration on a tongue of the upper. The motorized tensioning device is activated by a pressure force applied on the sole structure. A first portion of the first lace member extends through a first region of the upper and wherein the first region of the upper is adjusted when the motorized tensioning device is activated. A second portion of the second lace member extends through a second region of the upper and wherein the second region of the upper is adjusted when the motorized tensioning device is activated. Wherein the first region is different from the second region.

In another aspect, an article of footwear comprises an upper, a sole structure attached the upper, the sole structure it a midfoot region. The midfoot region includes a motorized tensioning device fixedly attached. The motorized tensioning device including a shaft member a first lace member, a second lace member. The first lace member includes a first tensioning portion and a second tensioning portion. The second lace member includes a third tensioning portion and a fourth tensioning portion. The first tensioning portion and the second tensioning portion are associated with a first amount of tension. The third tensioning portion and the fourth tensioning portion are associated with a second amount of tension. Wherein the first amount of tension is different than the second amount of tension.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
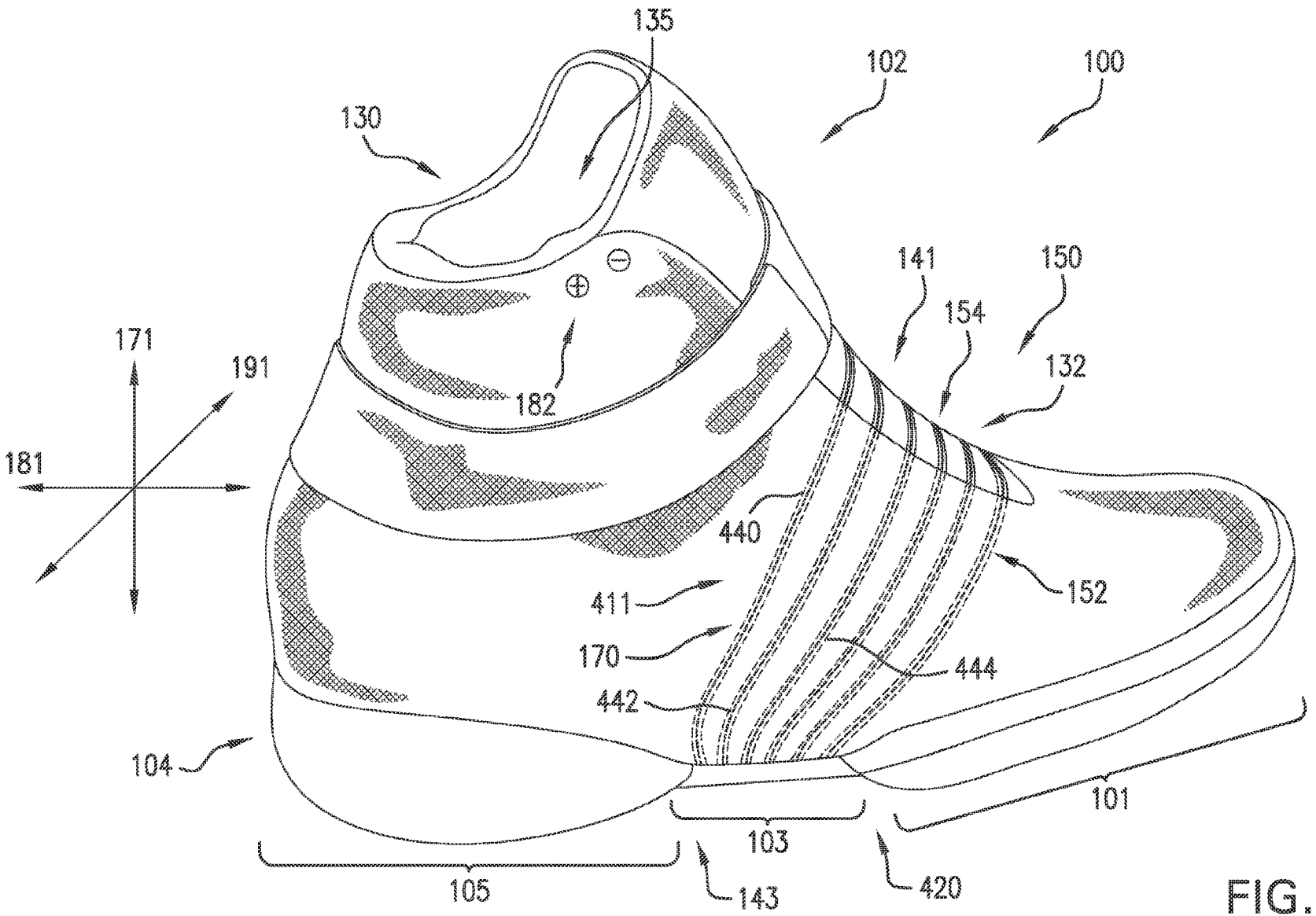
FIG. 1 is a schematic side view of an embodiment of an article of footwear with a tensioning system.

FIG. 1 illustrates a schematic side view of an embodiment of article of footwear 100 that is configured with a tensioning system 150. In the current embodiment, article of footwear 100, also referred to hereafter simply as article 100, is shown in the form of an athletic shoe. However, in other embodiments, tensioning system 150 may be used with any other kind of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear. As discussed in further detail below, a tensioning system may not be limited to footwear and in other embodiments a tensioning system could be used with various kinds of apparel, including clothing, sportswear, sporting equipment and other kinds of apparel. In still other embodiments, a tensioning system may be used with braces, such as medical braces.

Referring to FIG. 1, for purposes of reference, article 100 may be divided into forefoot region 101, midfoot region 103 and heel region 105. Forefoot region 101 may be generally associated with the toes and joints connecting the metatarsals with the phalanges. Midfoot region 103 may be generally associated with the arch of a foot. Likewise, heel region 105 may be generally associated with the heel of a foot, including the calcaneus bone. It will be understood that forefoot region 101, midfoot region 103 and heel region 105 are only intended for purposes of description and are not intended to demarcate precise regions of article 100.

For consistency and convenience, directional adjectives are also employed throughout this detailed description corresponding to the illustrated embodiments. The term "lateral" or "lateral direction" as used throughout this detailed description and in the claims refers to a direction extending along a width of a component or element. For example, a lateral axis 191 of article may extend between a medial side 141 and a lateral side 143 of the foot. Additionally, the term "longitudinal" or "longitudinal direction" as used throughout this detailed description and in the claims refers to a direction extending across a length or breadth of an element or component (such as a sole member). In some embodiments, a longitudinal axis 181 may extend from forefoot region 101 to heel region 105 of a foot. It will be understood that each of these directional adjectives may also be applied to individual components of an article of footwear, such as an upper and/or a sole member. In addition, a vertical axis 171 refers to the axis perpendicular to a horizontal surface defined by longitudinal axis 181 and lateral axis 191. It will be understood that each of these directional adjectives may be applied to various components shown in the embodiments, including article 100, as well as components of tensioning system 150.

Article 100 may include upper 102 and sole structure 104. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used. Examples of ground surfaces include, but are not limited to: natural turf, synthetic turf, dirt, as well as other surfaces.

In different embodiments, sole structure 104 may include different components. For example, sole structure 104 may include an outsole, a midsole, and/or an insole. In addition, in some cases, sole structure 104 can include one or more cleat members or traction elements that are configured to increase traction with a ground surface.

In some embodiments, sole structure 104 may be joined with upper 102. In some cases, upper 102 is configured to wrap around a foot and secure sole structure 104 to the foot. In some cases, upper 102 may include opening 130 that provides access to an interior cavity 135 of article 100.

Some embodiments may include provisions for facilitating the adjustment of an article to a wearers foot. In some embodiments, these provisions may include a tensioning system. In some embodiments, tensioning system may further include other components to include, but are not limited to, a motorized tensioning device, a housing unit, tensioning members, a motor, gears, spools or reels. Such components may assist in securing and providing a custom fit to a wearer's foot. These components and how, in various embodiments, they may secure the article to a wearers foot and provide a custom fit will be explained further in detail below.

In different embodiments, a tensioning system may include a tensioning member. The term "tensioning member" as used throughout this detailed description and in the claims refers to any component that has a generally elongated shape and high tensile strength. In some cases, a tensioning member could also have a generally low elasticity. Examples of different tensioning members include, but are not limited to: laces, cables, straps and cords. In some cases, tensioning members may be used to fasten and/or tighten an article, including articles of clothing and/or footwear. In other cases, tensioning members may be used to apply tension at a predetermined location for purposes of actuating some components or system.

A tensioning system may include provisions for providing a customizable and comfortable fit of an article to a wearer's foot. In some embodiments, the provisions may comprise of various components and systems for modifying the dimensions of interior cavity 135 and thereby tightening (or loosening) upper 102 around a wearer's foot. In some embodiments, tensioning system 150 may comprise tensioning member or lace 152 as well as a motorized tensioning device 160.

Figure 10:
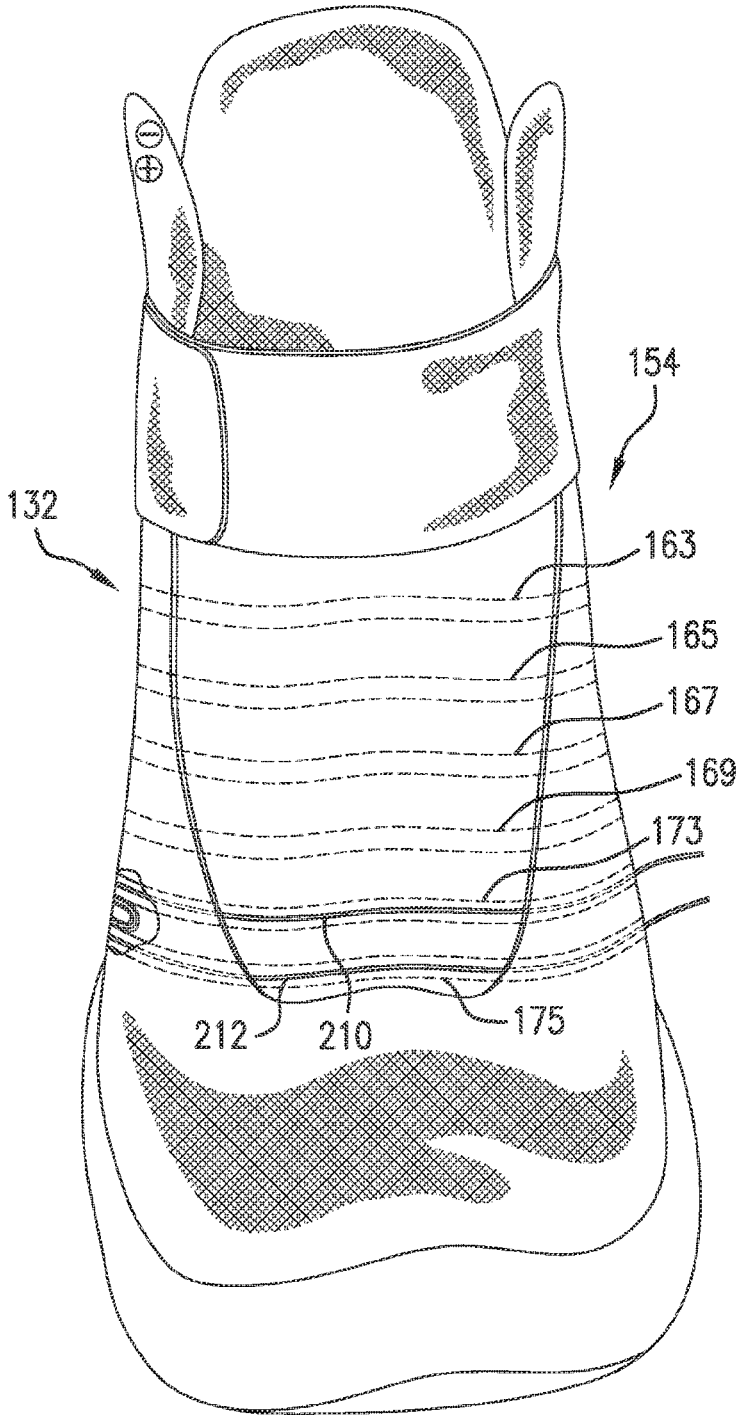
FIGS. 10-12 are schematic views of a lacing embodiment to motorized tensioning device.
Figure 11:
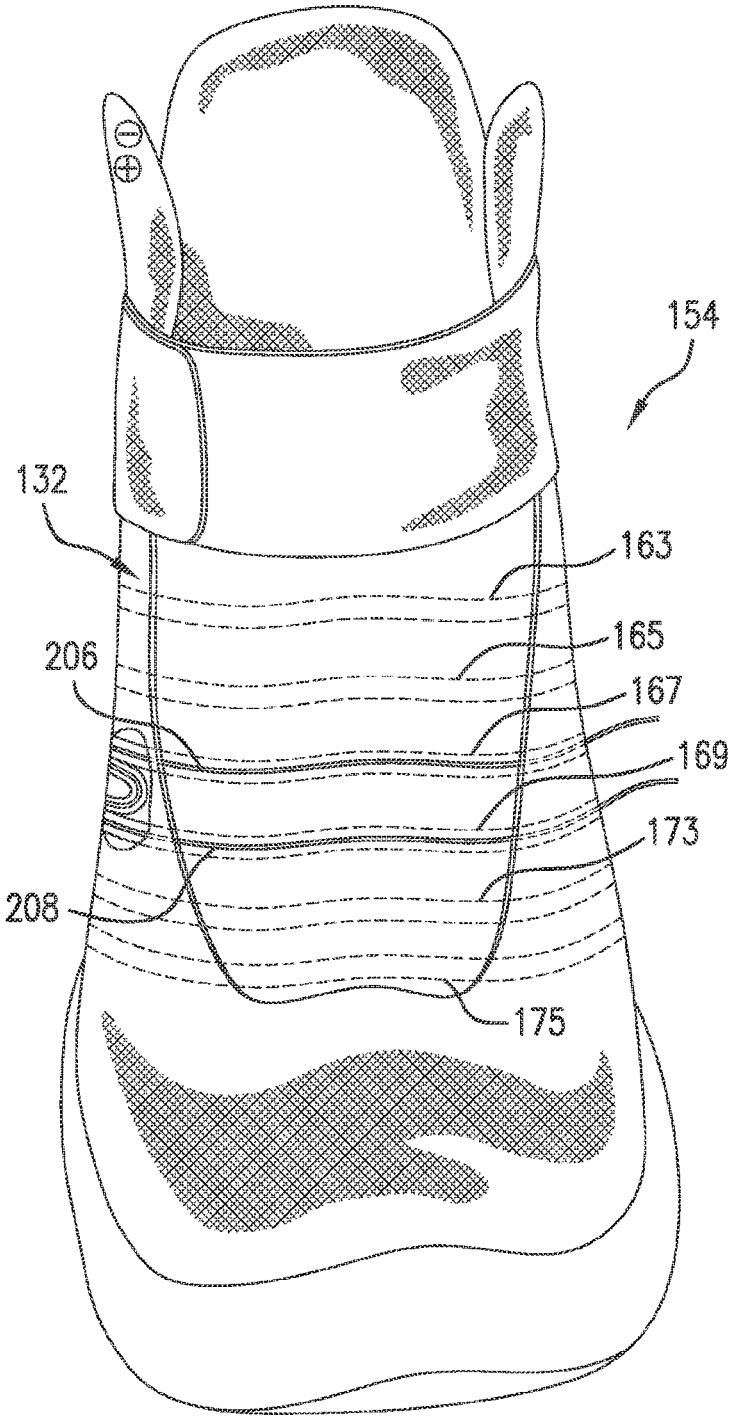
Figure 12:
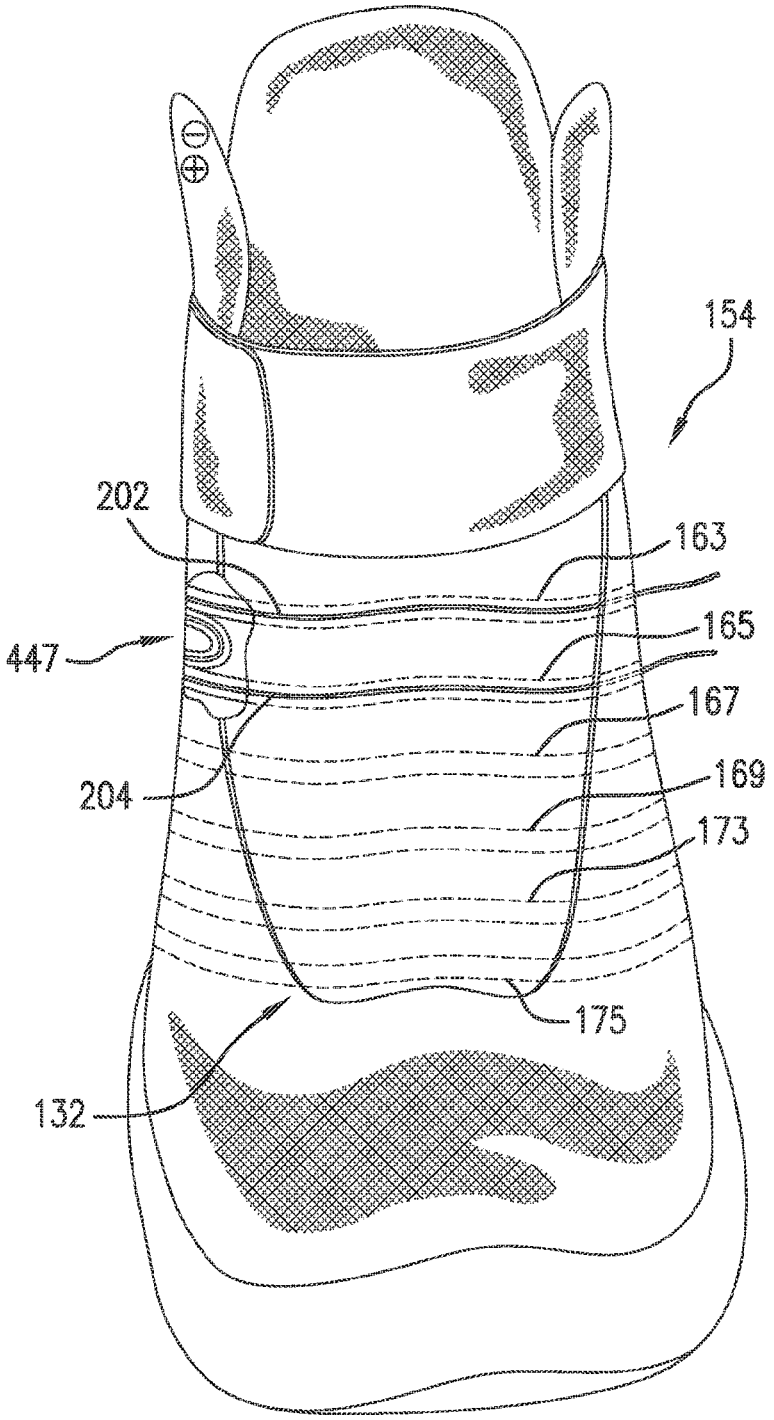

In some embodiments, lace 152 may be configured to pass through various different lacing guides 154 (as shown in phantom lines in FIGS. 10-12), which may be further associated with the edges of throat opening 132. In some cases, lacing guides 154 may provide a similar function to traditional eyelets on uppers. In particular, as lace 152 is pulled or tensioned, throat opening 132 may generally constrict so that upper 102 is tightened around a foot. In one embodiment, lacing guides 154 may comprise a first lacing guide 163, a second lacing guide 165, a third lacing guide 167, a fourth lacing guide 169, a fifth lacing guide 173, and a sixth lacing guide 175 (as shown in FIGS. 10-12).

In some embodiments, lacing guides 154 may be used to arrange lace in different configurations. Further, lacing guides 154 may be used to facilitate the tightening or loosening of lace 152 while in various states of tension. For example, in some embodiments, lacing guides 154 may expand as lace 152 is configured in a tensioned or tightened state. With this arrangement, lace 152 is provided more room when tensioning article. Likewise, in some embodiments, lacing guides 154 could compress as lace 152 is configured from a tensioned state to a non-tensioned or loose state. In some embodiments, lace 152, positioned through lacing guides 154, may be arranged in various configurations. Referring to FIGS. 1, 10-12, in one embodiment, lace 152 is arranged in parallel configuration on upper. In some other embodiments, lace 152 may be arranged, in a criss-cross pattern. In some other embodiments, lace 152, via lacing guides 154 may be arranged in a different configuration.

The arrangement of lacing guides 154 in this embodiment is only intended to be exemplary and it will be understood that other embodiments are not limited to a particular configuration for lacing guides 154. Furthermore, the particular types of lacing guides 154 illustrated in the embodiments are also exemplary and other embodiments may incorporate any other kinds of lacing guides or similar lacing provisions. In some other embodiments, for example, lace 152 could be inserted through traditional eyelets. Some examples of lace guiding provisions that may be incorporated into the embodiments are disclosed in Cotterman et al., U.S. Patent Application Publication No. 201/0000091, now U.S. application Ser. No. 13/174,527, filed Jun. 30, 2011, and titled "Lace Guide", which is hereby incorporated by reference in its entirety. Additional examples are disclosed in Goodman et al., U.S. Patent Application Publication No. 2011/0266384, now U.S. application Ser. No. 13/098,276, filed Apr. 29, 2011 and titled "Reel Based Lacing System" (the "Reel Based Lacing Application"), which is hereby incorporated by reference in its entirety. Still additional examples of lace guides are disclosed in Kerns et al., U.S. Patent Application Publication No. 2011/0225843, now U.S. application Ser. no. 13/011,707, filed Jan. 21, 2011 and titled "Guides For Lacing Systems", which is hereby incorporated by reference in its entirety.

Lace 152 may comprise any type of type of lacing material known in the art. Examples of lace that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township N.J., although other kinds of extended chain, high modulus polyethylene fiber materials can also be used as a lace. Still further exemplary properties of a lace can be found in the Reel Based Lacing Application mentioned above.

Figure 2:
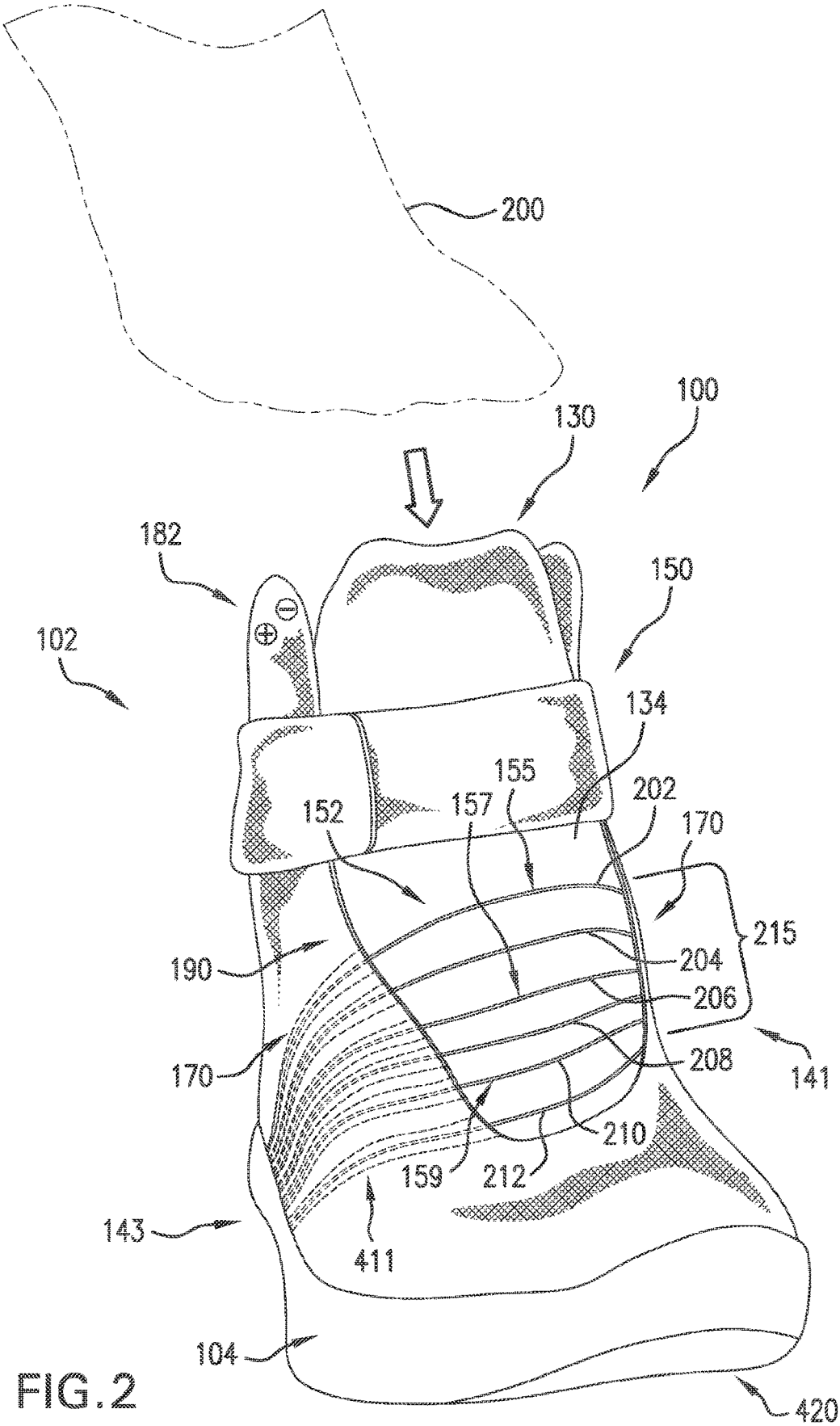
FIG. 2 is a schematic isometric view of an embodiment of an article of footwear with a tensioning system in a non-tensioned state.
Figure 3:
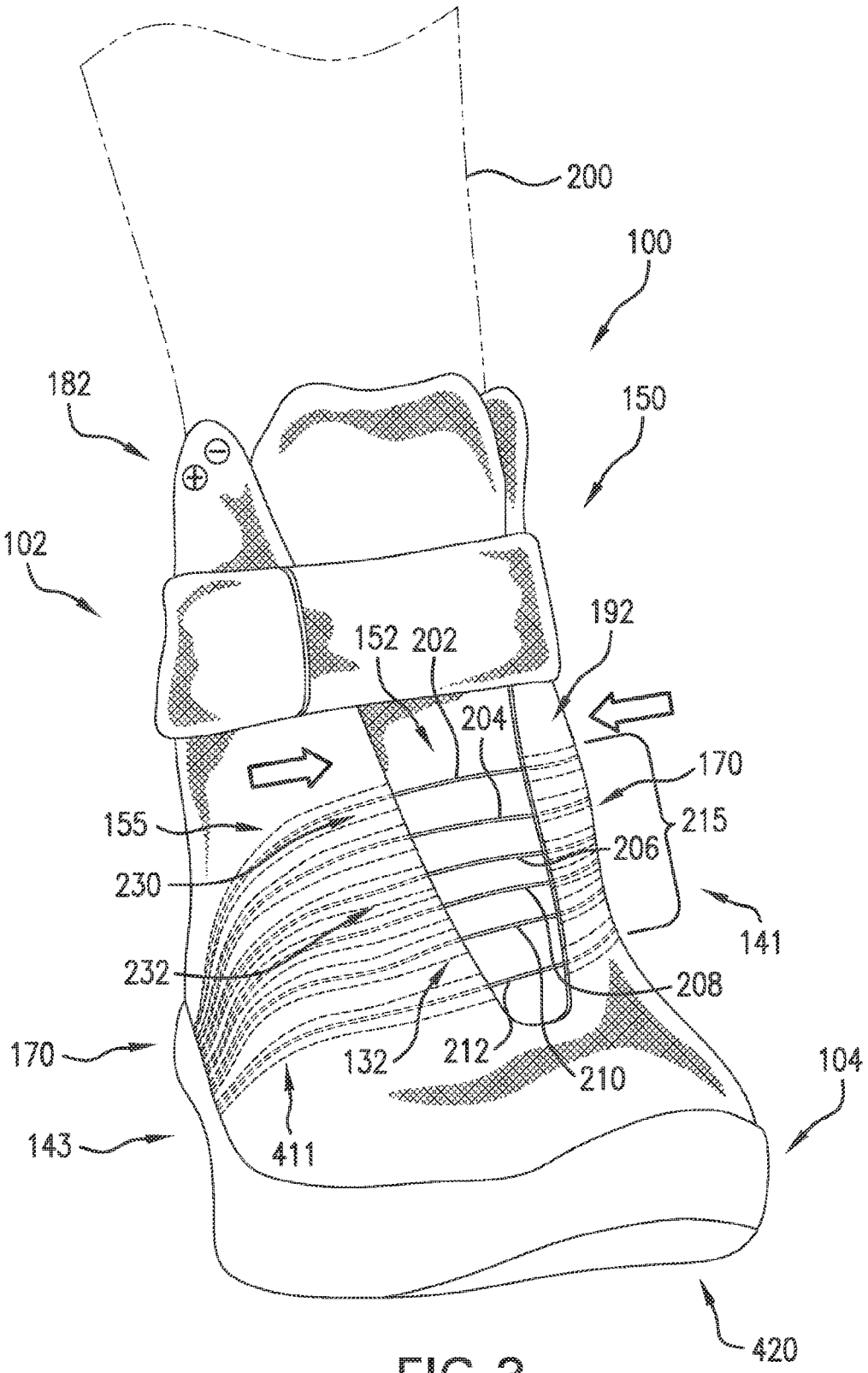
FIG. 3 is a schematic isometric view of an embodiment of article of footwear with a tensioning system in a tensioned state.

Article 100 may include a plurality of control buttons 182 that are capable of initiating control commands. In some embodiments, control buttons 182 may allow a user to tighten one or both shoes simultaneously. Optionally, some embodiments could include a "fully tighten" command that would tighten the footwear until a predetermined threshold is achieved (for example, a threshold pressure, winding distance, etc.). Article 100 may also include provisions for storing and using preferred tension settings. In some embodiments, control buttons 182 may be disposed somewhere along upper 102. In one embodiment, control buttons 182 may be disposed adjacent to opening 130, as shown in FIGS. 1-3. The operation of control buttons 182 to tighten, or loosen, tensioning system will be explained further in detail below.

FIG. 2 shows article 100 is in a fully opened or non-tensioned state just prior to the entry of foot 200. In this state, lace 152 may be loose enough to allow a user to insert his or her foot into opening 130. As seen in FIG. 2, in some embodiments, with tensioning system 150 in the open state, a foot can be easily and comfortably removed from footwear 100.

Generally, tensioning system 150 may include any number of laces. In some embodiments, only a single lace may be provided, in other embodiments, multiple laces may be provided. In this embodiment, lace 152 may refer collectively to first lace 155, second lace 157, and third lace 159 that are routed through portions of article 100. Further, the routing of lace 152 may dispose portions of first lace 155, second lace 157, and third lace 159 on a tongue section 134 of upper 102. In one embodiment, these portions on tongue section 134 may include first tensioning portion 202, second tensioning portion 204, third tensioning portion 206, fourth tensioning portion 208, fifth tensioning portion 210, and sixth tensioning portion 212. For clarity, first tensioning portion 202, second tensioning portion 204, third tensioning portion 206, fourth tensioning portion 208, fifth tensioning portion 210, and sixth tensioning portion 212 may be referred to collectively as tensioning set 215.

Figure 4:
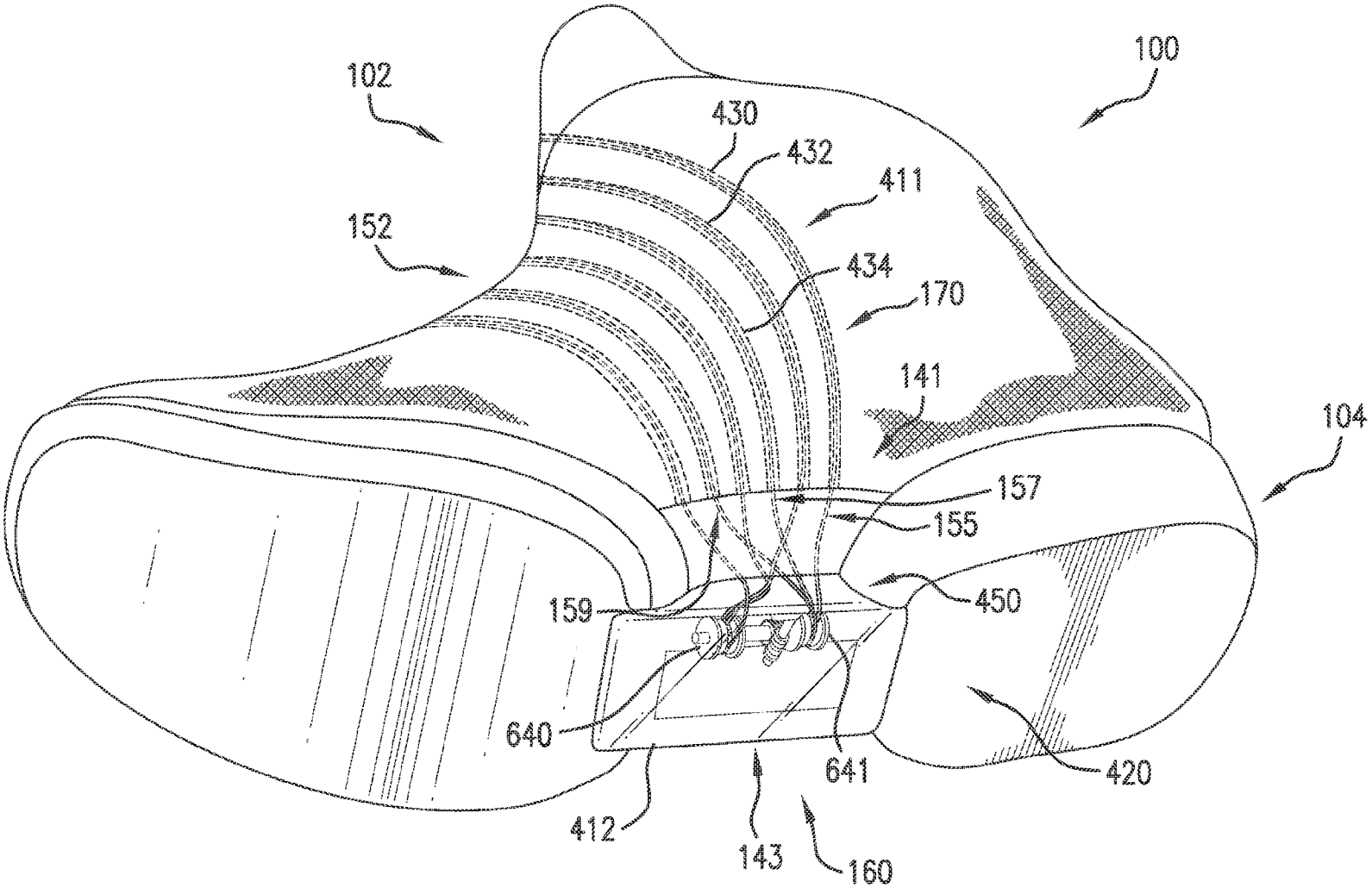
FIG. 4 is a schematic view of an embodiment of an article of footwear with a tensioning system.

Sortie embodiments may include provisions that provide a custom fit of an article to a wearer's foot. As used in this detailed description and in the claims, custom fit may refer to adjusting specific, localized portions or regions of an upper, as opposed to the entire upper, to comfortably fit the shape and contours of the article to a wearer's foot. In some embodiments, provisions include motorized tensioning device 160 (as shown in FIG. 4) comprised of components that may adjust portions of upper 102. In some embodiments, provisions may further include control mechanisms such as control buttons 182 allowing an incremental tightening or loosening of lace 152 and in particular, tensioning set 215.

Referring to FIGS. 2-4, tensioning system 150 may tighten lace 152 thereby adjusting upper 102 in a variety of ways. In some embodiments, prior to activation, lace 152 may be characterized as being in a state of non-tension 190, as shown in FIG. 2. In some embodiments, a pressure force, such as when a wearer inserts a foot and presses down on sole structure 104, may activate motorized tensioning device 160. The pressure force may result in motorized tensioning device 160 actuating components to draw lace 152 into housing unit 412. Alternatively, in some embodiments, an incremental tighten command may be sent to motorized tensioning device 160 by pressing control buttons 182. This command causes motorized tensioning device 160 to enter an incremental tighten mode. At this point, the tension of lace 152 is increased to tighten upper 102 around foot 200. In particular, as lace 152 is drawn into housing unit 412, tensioning set 215 may constrict throat opening 132. Further, increased tension of lace 152 will adjust different regions of the upper 102 due to the routing of lace 152. In some embodiments, during this event lace 152 may be characterized as being in a state of tension 191.

In some embodiments, when motorized tensioning device 160 is activated, portions of lace 152, in particular tensioning set 215, may adjust localized regions of upper 102. As used in this detailed description and in the claims, localized regions may refer to a particular zone, portion, or area of upper. In some embodiments, localized regions may extend along a lateral axis 191 between medial side 141 and lateral side 143. In some cases, localized region may be spaced apart from opening 135. In some other cases localized regions may be spaced along a longitudinal axis 181 extending between forefoot region 101 and midfoot region 103.

In some embodiments, by adjusting localized regions of upper 102, tensioning set 215 may apply different amounts of downward and inward pressure to the upper 102 as well. In one embodiment, first lace 155 may include first tensioning portion 202 and second tensioning portion 204 which adjusts a first region 230 of upper 102 during operation. First tensioning portion 202 and second tensioning portion may be associated with a first amount of tension that applies a downward and inward pressure to the upper 102. Further, second lace 157 may include third tensioning portion 206 and fourth tensioning portion 208 which adjusts a second region 232, which is spaced apart and different from first region 230, of upper 102 during operation. Likewise, third tensioning portion 206 and fourth tensioning portion 208 may be associated with a second amount of tension, which is different to first amount of tension. The second amount of tension will also apply downward and inward pressure to the upper 102.

In some cases, this incremental tightening can occur in discrete steps so that each time the wearer interacts with control buttons 182, lace 152 is taken up by a predetermined amount (for example by rotating a spool or a reel member within motorized tensioning device 160 through a predetermined angle). In other cases, this incremental tightening can occur in a continuous manner. In some cases, the speed of tightening can be set so that the system does not overshoot a preferred level of tightness (i.e., the system does not move between not tight enough and overly tight too quickly) while also being large enough to avoid overly long times for fully tightening article 100.

FIG. 4 schematically illustrates an exemplary placement of motorized tensioning device 160 when attached to footwear 100. In some embodiments, some components of motorized tensioning device 160 may be disposed in a housing unit 412.

In some embodiments, lace 152 may be routed from motorized tensioning device 160 throughout upper 102 such that lace 152 passes through internal channels 411 positioned along sidewall portions 170 (as seen in FIGS. 1-4). In some embodiments, internal channels 411 are disposed on sidewall portions 170 on medial side 141 and lateral side 143 of upper 102. Internal channels 411 may guide the lace 152 away from and back towards motorized tensioning device 160. The routing of lace 152 from motorized tensioning device 160 through upper 102 and back towards motorized tensioning device 160 will be explained further in detail below.

It is to be noted that the routing of lace 152 from motorized tensioning device 160 through regions of upper 102 may provide distinct advantages. In some embodiments, because of the arrangement in which lace 152 is routed, a majority of a length of lace 152 may be disposed outside of housing unit 142. Thus, more room may be provided in housing unit 412 to accommodate other components such as gears, motors, or batteries. Further, because housing unit 412 needs less space for lace 152, housing unit 412 may be reduced in size.

In some embodiments, motorized tensioning device 160 may be mounted along a region of sole structure 104. In one embodiment, motorized tensioning device 160 can be mounted on a lower surface 420 (the surface that is facing away from a foot when article 100 is worn by a user) of sole structure 104. In some embodiments, motorized tensioning device 160 can be mounted along midfoot region 103 of sole structure 104. In one embodiment, an external cavity 450 located on lower surface 420 of sole structure 104 may be configured to receive motorized tensioning device 160. In some other embodiments, motorized tensioning device 160 may be mounted on lower surface 420 in other ways known in the art.

Figure 5:
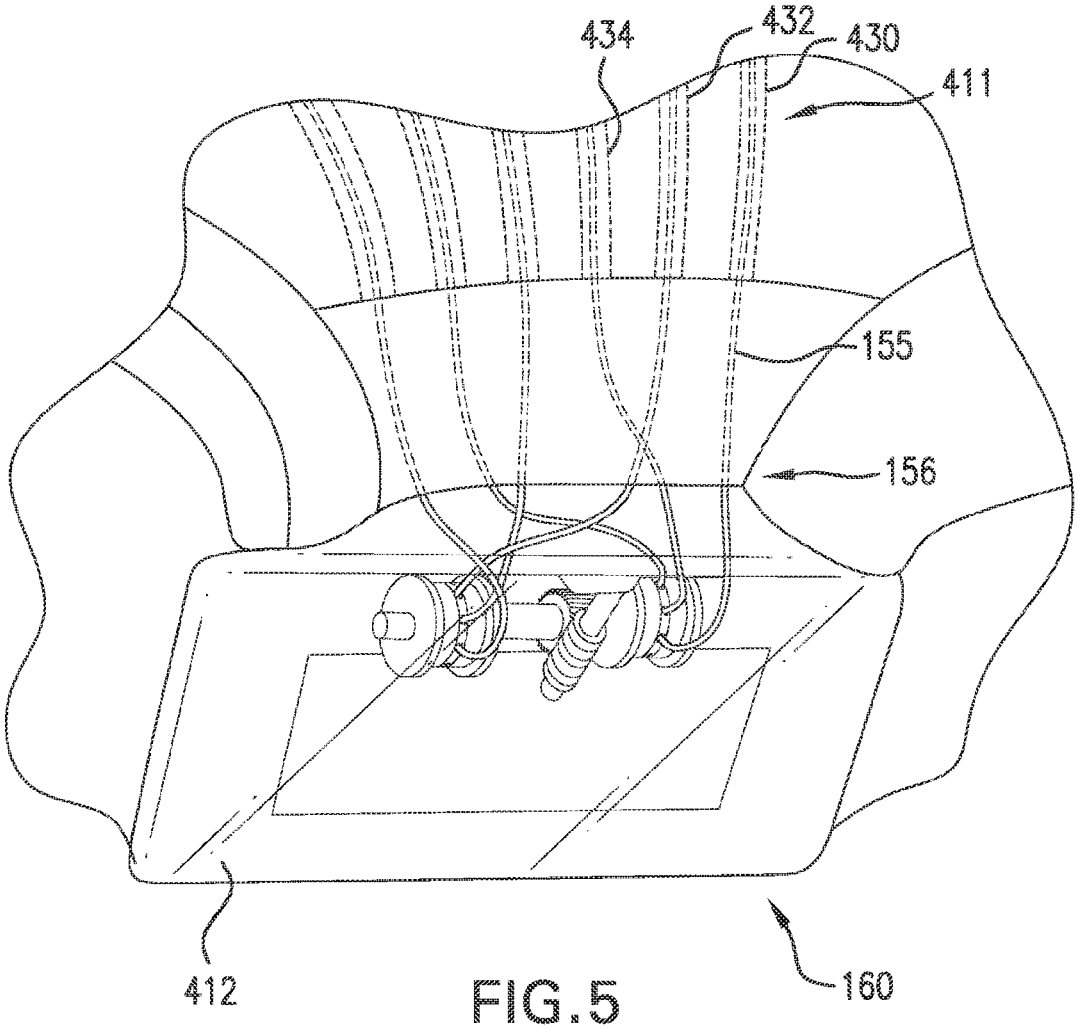
FIG. 5 is a schematic enlarged view of isolated components of an embodiment of a motorized tensioning device on an article of footwear.

In some cases, motorized tensioning device 160 may include provisions for receiving portions of lace 152. In some cases, lace 152 may exit internal channels 411 of upper 102 and pass through apertures 156 before entering housing unit 412 of motorized tensioning device 160 as seen in FIG. 5.

Provisions for mounting motorized tensioning device 160 to sale structure 104 can vary in different embodiments. In some cases, motorized tensioning device 160 may be removably attached, so that motorized tensioning device 160 can be easily removed by a user and modified (for example, when a lace must be changed). In other cases, motorized lacing device 160 could be fixedly attached to sole structure 104 permanently. In one embodiment, for example, an external harness (not shown) may be used to mount motorized tensioning device 160 to sole structure 104 at midfoot region 103. In other embodiments, motorized lacing device 160 can be joined in any manner to lower surface 420, including mechanical attachments, adhesives, and/or molding.

As previously stated, motorized tensioning device 160 may be configured to automatically apply tension to lace 152 for purposes of tightening and loosening upper 102. As described in further detail below, motorized tensioning device 160 may include provisions for winding lace 152 onto, and unwinding lace 152 from, reel elements internal to motorized tensioning device 160. Moreover, the provisions may include a motor assembly that actuates components for facilitating the winding and unwinding of lace 152 onto reel elements in response to various inputs or controls.

Throughout the detailed description and in the claims, various operating modes, or configurations, of a tensioning system are described. These operating modes may refer to states of the tensioning system itself, as well as to the operating modes of individual subsystems and/or components of the tensioning system. Exemplary modes include an "incremental tighten mode", an "incremental loosen mode" and a "fully loosen" mode. The latter two modes may also be referred to as an "incremental release mode" and a "full release mode". In the incremental tighten mode, motorized tightening device 160 may operate in a manner that incrementally (or gradually) tightens, or increases the tension of, lace 152. In the incremental loosen mode, motorized tightening device 160 may operate in a manner that incrementally (or gradually) loosens, or releases tension in, lace 152. As discussed further below, the incremental tighten mode and the incremental loosen mode may tighten and loosen a lace in discrete steps or continuously. In the full release mode, motorized tightening device 160 may operate in a manner so that tension applied to the lace by the system is substantially reduced to a level where the user can easily remove his or her foot from the article. This is in contrast to the incremental release mode, where the system operates to achieve a lower tension for the lace relative to the current tension, but not necessarily to completely remove tension from the laces. Moreover, while the full release mode may be utilized to quickly release lace tension so the user can remove the article, the incremental release mode may be utilized to make minor adjustments to the lace tension as a user searches for the desired amount of tension, thereby providing user with a custom fit. Although the embodiments describe three possible modes of operation (and associated control commands), other operating modes may also be possible. For example, some embodiments could incorporated a fully tighten operating mode where motorized tightening device 160 continues to tighten lace 152 Until a predetermined tension has been achieved.

Figure 7:
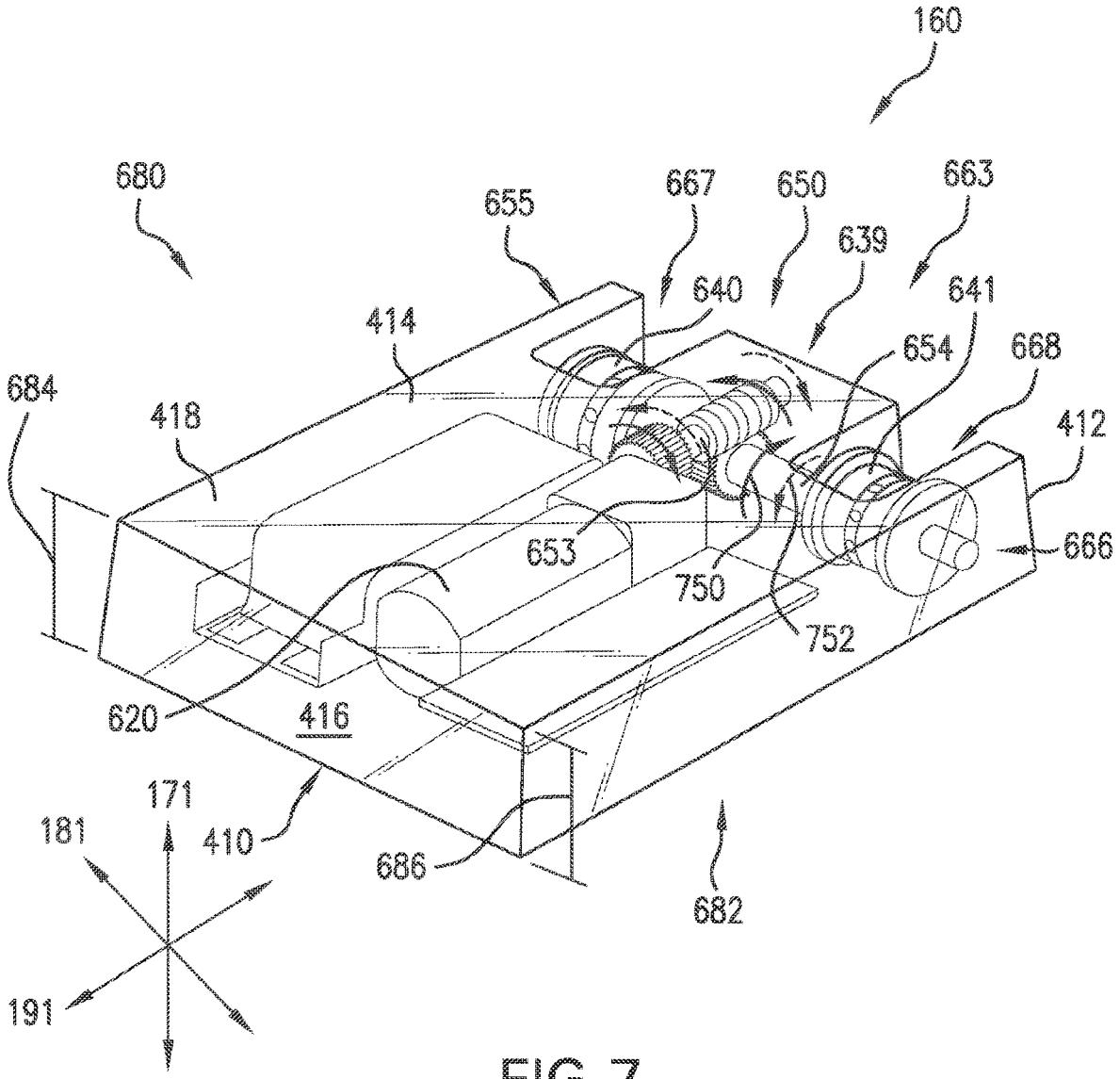
FIG. 7 is a schematic isometric view of an embodiment of a motorized tensioning device.
Figure 8:
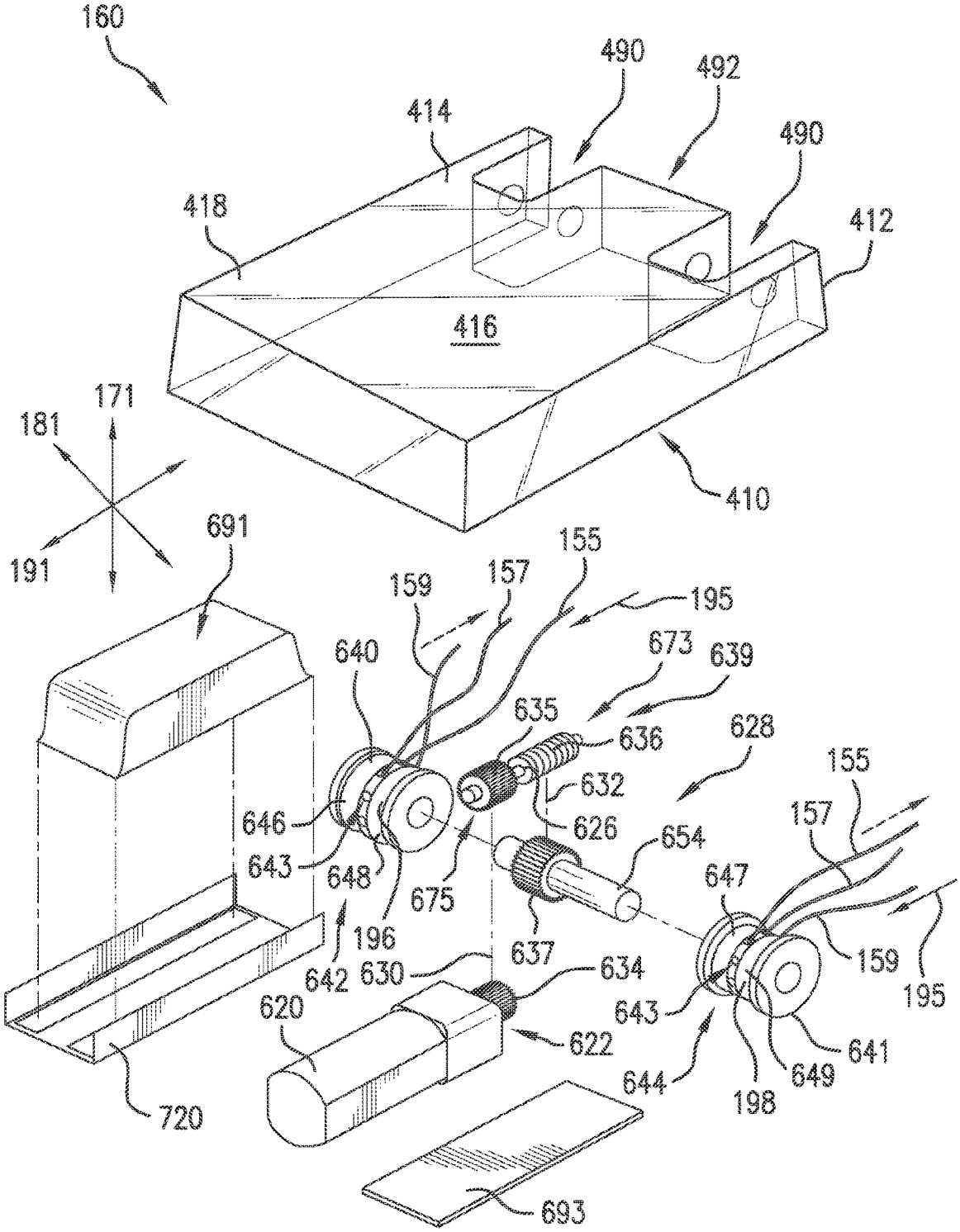
FIG. 8 is a schematic exploded view of an embodiment of a motorized tensioning device.
Figure 13:
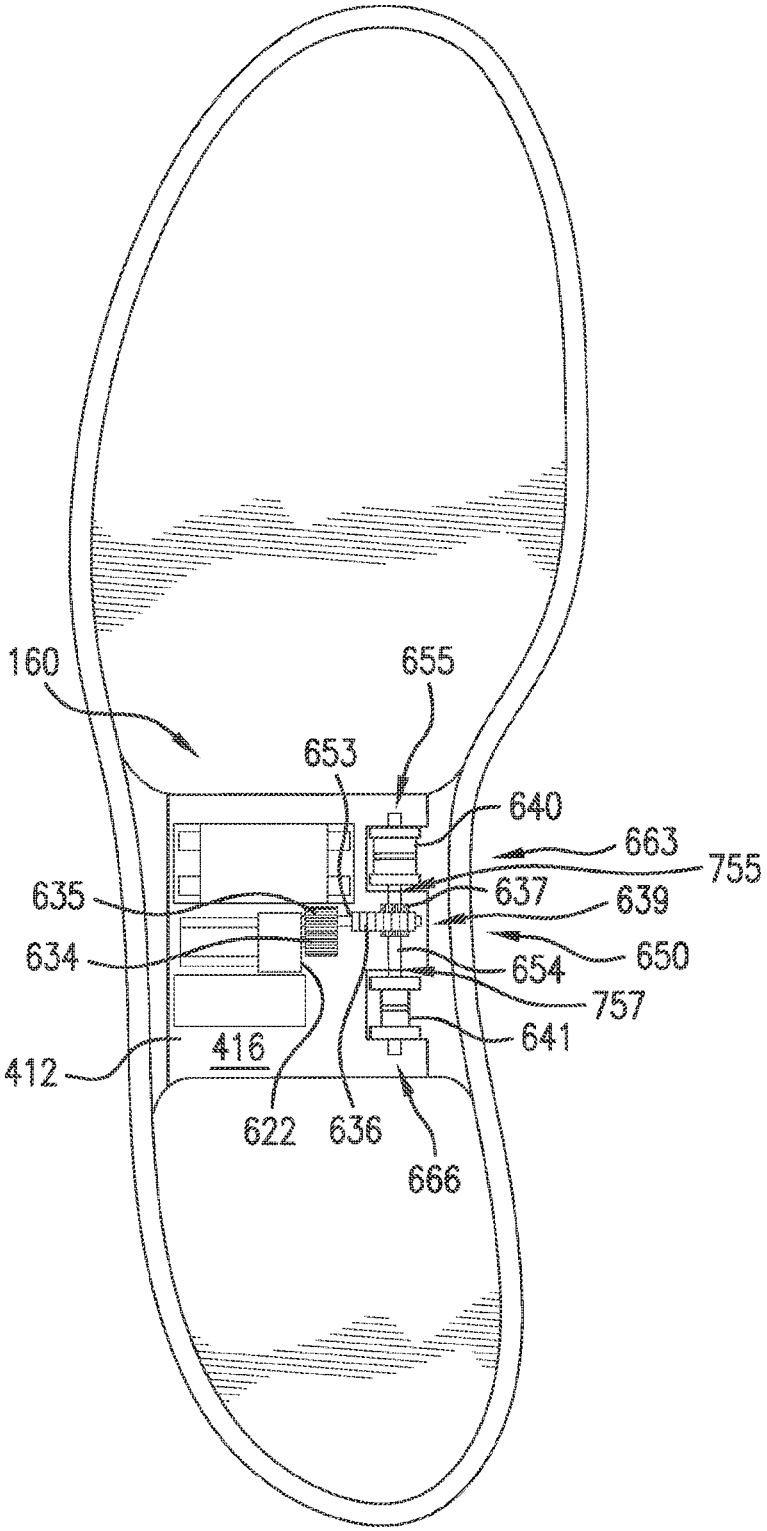
FIG. 13 is schematic bottom view of an article of footwear with a motorized tensioning device.

FIGS. 7, 8 and 13 illustrate exemplary components of motorized tensioning device 160. For purposes of illustration, some components of motorized tensioning device 160 have been omitted or depicted in isolation from other components.

Referring to FIG. 7, some components of motorized tightening device 160 are shown within a portion of housing unit 412. In some embodiments, housing unit 412 may be shaped so as to optimize the arrangement of components of motorized tensioning device 160. For example, the arrangement of components may allow housing unit 412 to have a tapered thickness, relative to a vertical axis, of housing unit 412.

In some embodiments, housing unit 412 may have a tapered vertical profile, as shown in FIG. 7. In other words, housing unit 412 may have a first end 680 with a first height 684, relative to vertical axis 171 and an opposite second end 682 with a second height 686, where first height 684 is greater than second height 686. It is to be noted that in some embodiments, first end 680 and second end 682 may be positioned along a longitudinal axis 181. In other embodiments, first end 680 and second end 682 may be positioned along a lateral axis 191.

Housing unit 412 may further include an inner housing portion 416 and an outer housing portion 418. Outer housing portion 418 may include a base panel 410 as well as an outer cover 414, and generally provides a protective outer covering for components of motorized tensioning device 160. Inner housing portion 416 may be shaped and include apertures 490 and cavities 492 to support components of motorized tensioning device 160 (as shown in FIG. 8). In some cases portions of inner housing portion 416 function to limit the mobility of some components, as discussed in detail below.

In some embodiments, motorized tensioning device 160 may include a motor assembly 620. In some embodiments, motor assembly 620 could include an electric motor. However, in other embodiments motor assembly 620 could comprise any kind of non-electric motor known in the art. Examples of different motors that can be used include, but are not limited to: DC motors (such as permanent-magnet motors, brushed DC motors, brushless DC motors, switched reluctance motors, etc.), AC motors (such as motors with sliding rotors, synchronous electrical motors, asynchronous electrical motors, induction motors, etc.), universal motors, stepper motors, piezoelectric motors, as well as any other kinds of motors known in the art. Motor assembly 620 may further include a motor crankshaft 622 that can be used to drive one or more components of motorized tensioning device 160. Provisions for powering motor assembly 620, including various kinds of batteries, are discussed in detail below.

In some embodiments, motorized tensioning device 160 can include provisions for reducing the output speed of, and increasing the torque generated by, motor assembly 620. In some embodiments, motorized tensioning device 160 can include one or more gear reduction assemblies and/or gear reduction systems. In some embodiments, motorized tensioning device 160 may include a single gear reduction assembly. In other embodiments, motorized tensioning device 160 may include two or more gear reduction assemblies Referring to the exploded view of FIG. 8, in one embodiment, motorized tensioning device 160 includes first gear reduction assembly 630 and second gear reduction assembly 632, which may be collectively referred to as gear reduction system 628. First gear reduction assembly 630 may be a clear reduction assembly that is generally aligned with motor assembly 620 and/or crankshaft 622 (also shown in FIG. 13). In contrast, second gear reduction assembly 632 may provide additional gear reduction that extends in a generally perpendicular direction to the orientation of crankshaft 622. In one embodiment, gear reduction system 628 may be mechanically coupled with motor assembly 620. With respect to housing unit 412, in some embodiments, first gear reduction assembly 630 may extend along lateral axis 191 of housing unit 412 while second gear reduction assembly 632 may extend along a longitudinal axis 181 of housing unit 412. By using a combination of in-line gears and horizontally spaced gears, relative to the orientation of crankshaft 622, motor assembly 620 can be arranged in parallel with spools and a corresponding reel shaft (as discussed in further detail below). This arrangement may reduce the longitudinal space required to fit all the components of motorized tensioning device 160 within housing unit 412.

Each gear reduction assembly can comprise one or more gears. In some embodiments, first gear reduction assembly 630 comprises one or more gears. In some embodiments, first gear reduction assembly 630 may be driven by crankshaft 622, and include a first gear 634, a second gear 635, and a third gear 636.

In one embodiment, second gear reduction assembly 632 may be configured with an additional stage of gear, including a fourth gear 637. In this embodiment, fourth gear 637 acts in conjunction with third gear 636, for turning additional components of motorized tensioning device 160, as described in further detail below. In some embodiments, third gear 636 may comprise a worm and fourth gear 637 may comprise a worm wheel. In one embodiment, the operation and/or coupling of third gear 636 and fourth gear 637 may be referred to as a worm gear or worm drive 639 (also shown in FIG. 13), which will be discussed further below.

The current embodiment of second gear reduction assembly 632 includes one gear. However, other embodiments could use any other number of gears. Likewise, the number of gears comprising first gear reduction assembly 630 may vary in different embodiments. (Additionally, in different embodiments, the type of gears used in first gear reduction assembly 630 and/or second gear reduction assembly 632 could vary. In some cases, spur gears may be used. Other examples of gears that may be used include, but are not limited to: helical gears, external gears, internal gears, bevel gears, crown gears, worm gears, non-circular gears, rack and pinion gears, epicyclic gears, planetary gears, harmonic drive gears, cage gears, magnetic gears as well as any other kinds of gears and/or any combinations of various kinds of gears. The number, type and arrangement of gears for gear reduction system 628 may be selected to achieve the desired tradeoff between size, torque and speed of the motorized tensioning device 160.

In some embodiments, motorized tensioning device 160 can include provisions for winding and unwinding portions of a lace. As stated previously, in some embodiments, motorized to device 160 can include one or more spools or reel members. In some cases, motorized tensioning device 160 may include a first reel member 640 and a second reel member 641. First reel member 640 and second reel member 641 may be referred to collectively as reel members 663.

Figure 6:
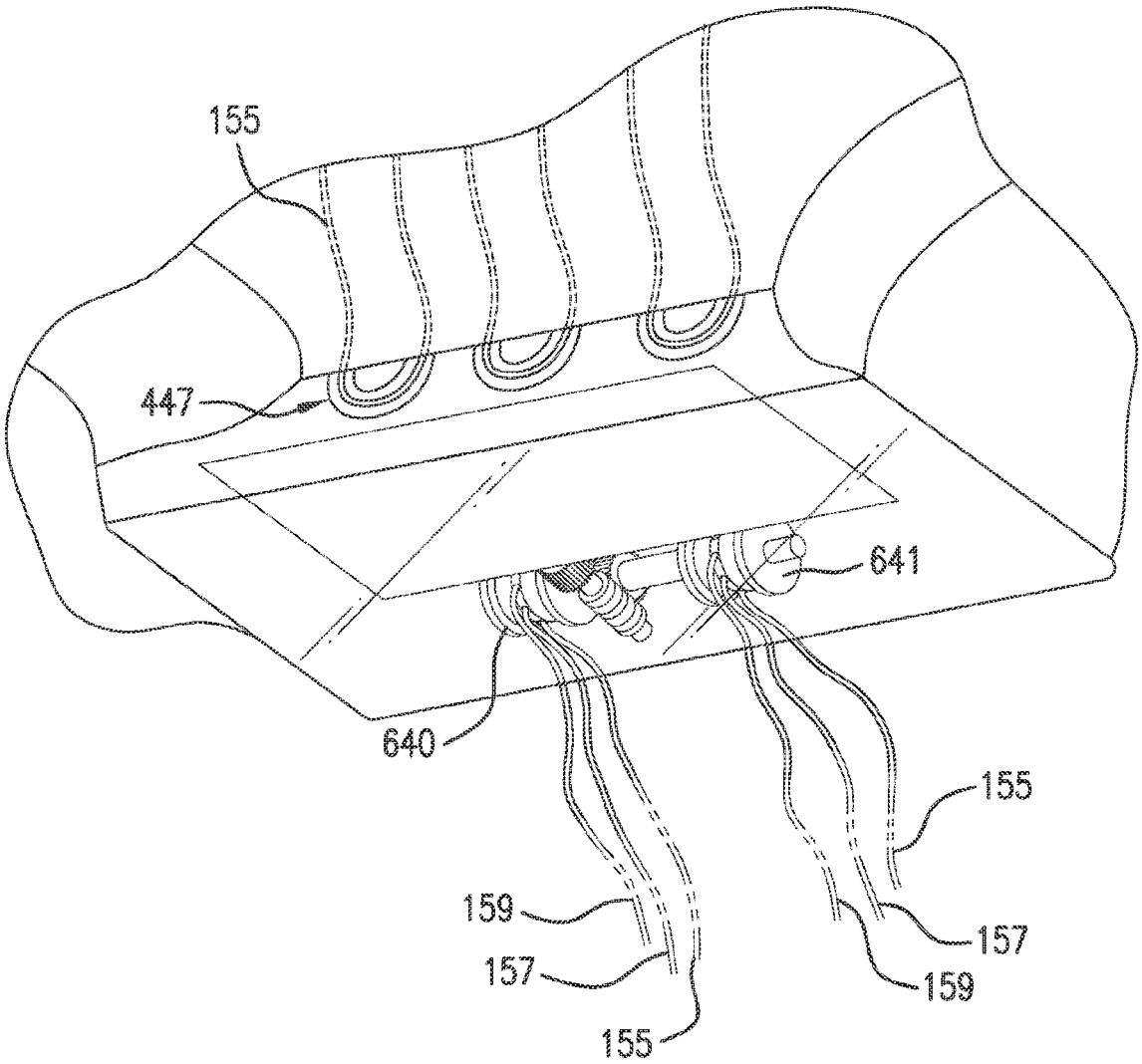
FIG. 6 is a schematic enlarged view of isolated components of an embodiment of motorized tensioning device on an article of footwear.

Some embodiments allow for different combinations of securing lace 152 onto several reel members 663. In some embodiments, first lace 155 may have a first end secured to first reel member 640, and a second end secured to second reel member 641. In embodiments where there are multiple laces, any combination may be used for securing lace 152 or multiple laces members onto reel members 663. Referring to FIGS. 6 and 8, in one embodiment, first lace 155, second lace 157, and third lace 159 may have one end secured to first reel member 640. Likewise, first lace 155, second lace 157, and third lace 159 may have the opposite end secured to second reel member 641. In some other embodiments, first lace 155 may have both ends attached to first reel member 640, while second lace 157 may have its respective ends attached to second reel member 641 (as shown schematically in FIG. 9). In still some other embodiment, first lace 155 and second lace 157 may be attached to both first reel member 640 and second reel member 641, whereas third ace 159 may be have its end attached to second reel member 641. With this arrangement, the pull-in rate 195, or the speed of winding lace 152 around reel members 663 may be varied. These variations may allow for customizing tension of lace 152 in relation to upper 102 and providing a custom fit.

In some embodiments, reel members 663 may be so dimensioned to further provide a custom fit to the wearer. In some embodiments, the diameter of reel members 663 may be varied to accommodate pull-in rate 195 of lace 152. For example, as shown in FIGS. 7 and 8, first reel member 640 may have a first diameter 196 larger than second diameter 198 of second reel member 641. The varying diameters, when combined with gear reduction system 628, allow for accommodating the different pull-in rates of lace 152 as they are pulled into housing unit 412.

In some embodiments, during operation, the routing of first lace 155, second lace 157, and third lace 159 from housing unit 412 may also vary the tension of lace 152 and tensioning set 215. By varying the tension, the amount of downward and inward pressure placed on localized regions or zones of upper 102 can be balanced and varied on the wearer's foot.

Figure 9:
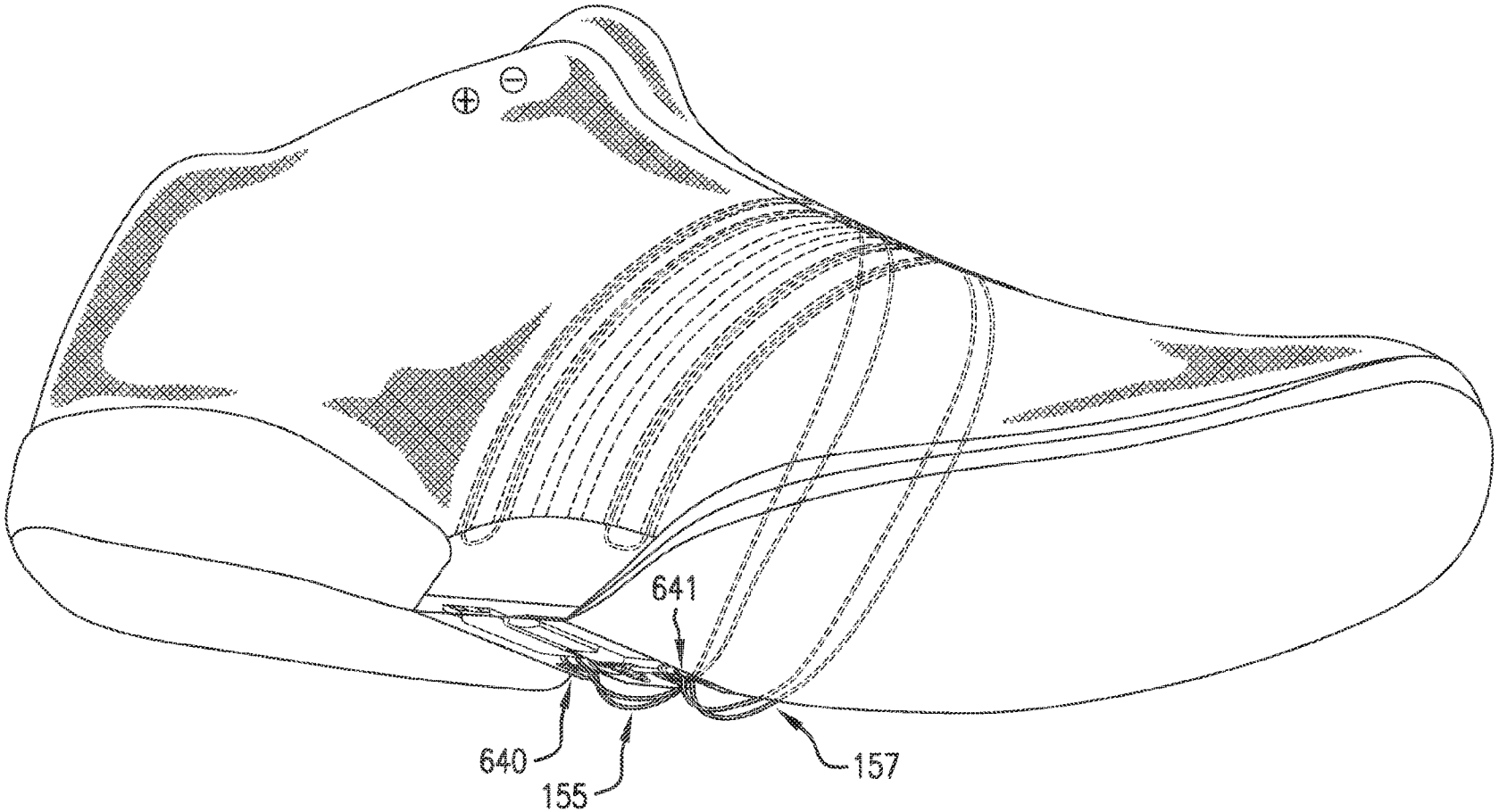
FIG. 9 is a schematic view of an embodiment of a routing of the lace s on an article of footwear with a motorized tensioning device.

In an exemplary embodiment, first lace 155, with one end secured to first reel member 640, may exit housing unit 412 (as shown generally in FIGS. 4, 5 and 9). First lace 155 may then extend upwards along a first medial internal channel 430 on a side portion of upper 102, continue through lacing guides 154 positioned on tongue section 134 as first tensioning portion 202 (as seen in FIGS. 2 and 12), and then down trough a first lateral internal channel 440 on opposite lateral side 143 of upper (as shown generally in FIG. 1). First lace 155 may then pass through a first loop channel 447 which routes first lace 155 back to housing unit 412 (as shown in FIGS. 6 and 12). Therefore, first lace 155 may be configured to pass upward through second lateral internal channel 442 (as shown in FIG. 1), adjacent first lateral internal channel 440, then extend through lacing guides 154 as second tensioning portion 204 (as shown in FIGS. 2 and 12). Referring to FIG. 4, first lace 155 will then continue down through second medial internal channel 432 adjacent first medial internal channel 430, and back into housing unit 412 with second end secured to second reel member 641. Likewise, second lace 157, and third lace 159 may be routed in a similar fashion. As discussed earlier, in some other embodiments, third lace 159, for example, may have both ends secured to second reel member 641.

In another embodiment, as first lace 155 is routed back to housing unit 412 from lateral side 143, first lace 155 may be configured to pass through non-adjacent internal channels 411. For example, in some embodiments, as first lace 155 is routed back to housing unit 412 from lateral side 143, first lace 155 may be configured to pass through third lateral internal channel 444 which is not adjacent to first lateral internal channel 440 (as shown in FIG. 1). It is to note that first loop channel 447 may be configured to route first lace 155 from first lateral channel 440 to third lateral channel 444. Continuing, first lace 155 may continue through lacing guides 154, as third tensioning portion 206, and then routed through third medial internal channel 434 before the second end enters housing unit 412 and is secured to second reel member 641. In other embodiments, lace 152 may be routed through different internal channels 411 and positioned in lacing guides 154 as different portions of tensioning set 215. With this arrangement, different tensions may be applied to lace 152 and tensioning set 215 in order to vary the amount of pressure on different regions of upper 102 during operation.

In some embodiments, when combined with lacing guides 154 arranged in parallel configuration, the amount of tension of first tensioning portion 202 proximal to opening 130, may be less than the amount of tension of sixth tensioning portion 212 proximal to forefoot region 101. In some embodiments, second tensioning portion 204, third tensioning portion 206, fourth tensioning portion 208, and fifth tensioning portion 210 may also have varying degrees of tension. The decreased tension of first tensioning portion 202 near the top of the article reduces an amount of pressure placed on the top of a wearer's foot which in turn reduces friction between the wearer's foot and article 100. With this arrangement, a custom fit is provided, with varying pressure throughout upper 102. Notably and in contrast to a single lace routed through an upper, independently controlling several lace members that loop around different regions of upper will balance the pressure or load at those different regions. Further, this balancing of pressure occurs simultaneously during the operation of motorized tensioning device 160.

Figure 15:
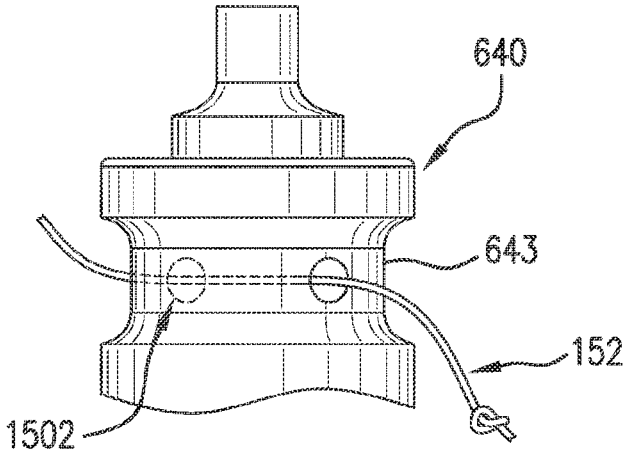
FIG. 15 is a schematic isometric view of an embodiment of a reel member.

Referring to FIG. 6, in some embodiments, first reel member 640 may further comprise a first receiving portion 642 for receiving a lace, and second reel member 641 may comprise a second receiving portion 644 for receiving a lace. Moreover, in some cases, first receiving portion 642 may comprise a first lace winding region 646 and a second lace winding region 648, which in some cases can be used to separately wind two ends of a lace. In addition, second receiving portion 644 may comprise a third lace winding region 647 and a fourth lace winding region 649. Since torque output goes down as lace 152 builds up in diameter, using separate winding regions for each lace end may help decrease the diameter of wound lace on reel members 663 and thereby minimize torque output reduction. In some cases, first lace winding region 646 and second lace winding region 648 may be separated by a dividing portion 643, which may include a lace receiving channel 645 for permanently retaining a portion of the lace on first reel member 640 (as shown in FIG. 15). Lace 152 may be secured to reel members 663 by any method known in the art. In some cases, reel apertures 1502, may be used for inserting lace 152 and the tying ends into a knot. In other cases, different methods may be used.

In other cases, however, first receiving portion 642 may comprise a single lace winding region. Similarly, third lace winding region 647 and fourth lace winding region 649 may be separated by a dividing portion, which may include a lace receiving channel for permanently retaining a portion of the lace on second reel member 641. In other cases, however, second receiving portion 644 may comprise a single lace winding region.

Motorized lacing system 160 may include provisions for transferring torque between a first gear reduction assembly 630 and second gear reduction assembly 632. Furthermore, in some embodiments, motorized lacing system 160 may include provisions for transferring torque from second gear reduction assembly 632 (or more generally from gear reduction system 628) to first reel member 640 and/or second reel member 641 in a manner that allows for incremental tightening, incremental loosening and full loosening of a lace. In one embodiment, motorized lacing system 160 may be configured with a torque transmitting system as the primary means for the transmission of torque from worm drive 639 to first reel member 640 and/or second reel member 641 in order to wind (or unwind) lace 152.

Referring to FIGS. 7 and 13, torque transmitting system 650 may further comprise various assemblies and components. In some embodiments, torque transmitting system 650 may include a first shaft and a second shaft and a rotation control assembly. In one embodiment, the first shaft is a worm shaft 653, and the second shaft is a reel shaft 654, and the rotation control assembly is in the form of worm drive 639. More specifically, these components operate in a manner that allows for incremental tightening (spool winding), incremental loosening (spool unwinding) as well as full tension release (during which time substantially no torque is transferred from fourth gear 637 to first reel member 640 and second reel member 641).

Some embodiments can also include a fixed bearing, which may be associated with an end of reel shaft 654. In some embodiments, an end portion of reel shaft 654 may be received within a recess of inner housing portion 416. In some embodiments, both ends of reel shaft 654 may be received within inner housing portion 416. For example, as shown in FIG. 7, a first end portion 655 may be disposed in a first recess 667, and second end portion 666 may be disposed in a second recess 668.

Figure 14:
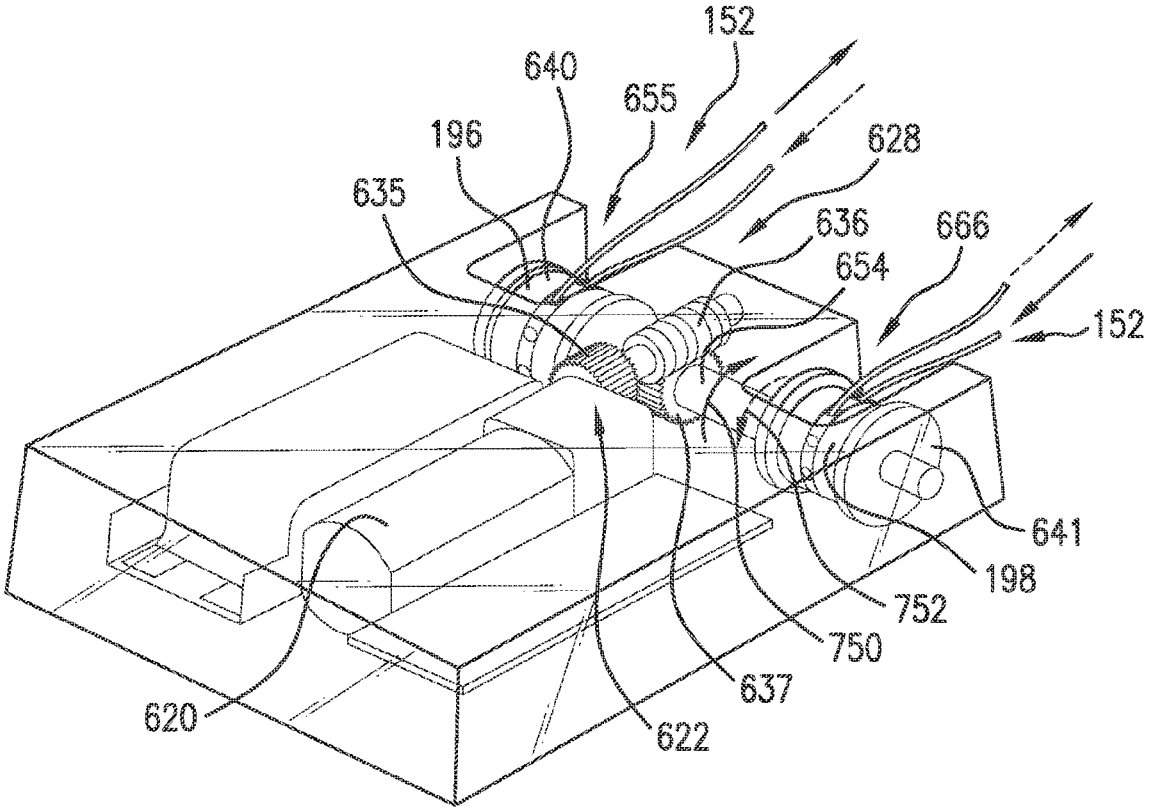
FIG. 14 is a schematic isometric embodiment of a motorized tensioning device.

In some cases, different advantages result from the positioning of reel members 663 at different locations within torque transmitting system 650. Referring to FIG. 14, in one embodiment, first reel member 640 and second reel member 641 may be positioned and concentrically mounted at opposite ends of reel shaft 654. In other words, first reel member 641 may be concentrically mounted at first end portion 655 of reel shaft 654, and second reel member 642 may be concentrically mounted at second end portion 666.

In some other embodiments, positioning reel members 663 at opposite ends of reel shaft 654 may provide gear reduction system 628 more robust capabilities to withstand increased amounts of tension and pressure force exerted on sole structure 104. In some cases, positioning reel members 663 this way may further vary the amount of tension for lace 152 throughout upper 102 during operation.

As seen in FIG. 13, first end portion 655 of reel shaft 654 may be attached to housing unit 412. Further, a first shaft distance 755 may be disposed between torque transmitting system 650 and inner housing portion 416 of housing unit 412. As first shaft distance 755 is relatively short, securing first end portion 655 of reel shaft 654 into housing unit 412 provides motorized tensioning device 160 with greater structural capabilities. Likewise, second shaft distance 757 may be associated with second end portion 666. In contrast to embodiments where a reel shaft has a relatively long shaft distance between a torque transmitting system and a housing unit, the shorter length of first shaft distance 755 provides motorized tension device 160 with increased structural integrity. This increased structural integrity allows for smaller components to be placed and used in housing unit 412. Further, in some embodiments, the shorter length of first shaft distance 755 and second shaft distance 757, relative to torque transmitting system 650, enables greater torque to be applied during operation.

In some embodiments, motorized tensioning device 160 may include provisions for adjusting the operation of motor assembly 620 according to one or more feedback signals. In some embodiments, for example, motorized tensioning device 160 may include a limit switch assembly. Generally, a limit switch assembly may detect current across portions of the system and vary operation of motor assembly 620 according to the detected current.

For purposes of reference, the following detailed description uses the terms "first rotational direction" and "second rotational direction" in describing the rotational directions of one or more components about an axis. For purposes of convenience, the first rotational direction and the second rotational direction refer to rotational directions about a longitudinal axis 181 of reel shaft 654 and are generally opposite rotational directions. The first rotational direction may refer to the clockwise rotation of a component about longitudinal axis 181, when viewing the component from the vantage point of second end portion 666 of reel shaft 654. The second rotational direction may be then be characterized by the counterclockwise rotation of a component about longitudinal axis 181, when viewing the component from the same vantage point.

A brief overview of the operation of motorized tensioning device 160 is described here. Referring to FIGS. 7, 13 and 14, in the incremental tighten mode motor assembly 620 may begin operating in order to rotate crankshaft 622. Crankshaft 622 may turn an input gear (here, first gear 634) of first gear reduction assembly 630, such that the output gear (here, second gear 635) of first gear reduction assembly 630 drives third gear 636. Thus, second gear 635 and third gear 636 both rotate, which drives fourth gear 637 in first rotational direction 750. As fourth gear 637 rotates, fourth gear 637 may engage and drive torque transmitting system 650 such that first reel member 640 and second reel member 641 may begin to rotate in first rotational direction 750. This may cause lace 152 to wind onto first receiving portion 642 of first reel member 640 and second receiving portion 644 of second reel member 641.

Furthermore, in the incremental loosen mode, motor assembly 620 may operate to rotate crankshaft 622. In the loosening mode, motor assembly 620 and crankshaft 622 turn in an opposite direction of the direction associated with tightening. The gear reduction system 628 is then driven such that fourth gear 637 of second gear reduction assembly 632 rotates in second rotational direction 752. In contrast to the incremental tighten mode, in the incremental loosen mode fourth gear 637 does not directly drive portions of torque transmitting system 650, first reel member 640 and second reel member 641. Instead, the motion of fourth gear 637 in the second rotational direction 752 causes the torque transmitting system 650 to momentarily release first reel member 640 and second reel member 641 allowing first reel member 640 and second reel member 641 to unwind by a predetermined amount after which the torque transmitting system reengages first reel member 640 and second reel member 641 and prevents further unwinding. This sequence of releasing and catching first reel member 640 and second reel member 641 occurs over and over as long as fourth gear 637 rotates in second rotational direction 752.

Finally, in the open or fully loosen mode, the torque transmitting system operates so that substantially no torque is transmitted to first reel member 640 and second reel member 641 from any components of the torque transmitting system 650. During this mode, first reel member 640 and second reel member 641 may rotate more easily in the unwinding direction or second rotational direction 752 about reel shaft 654.

In different embodiments, referring to third gear 636 and fourth gear 637, torque may be transmitted between worm shaft 654 and reel shaft 654. Third gear 636 may include an internally threaded cavity that may engage a threading on worm shaft 653. Fourth gear 637 may include an internally threaded cavity that may engage a threading on reel shaft 654. It is to be understood that characterizing third gear 636 and/or fourth gear 637 as part of one assembly does not preclude it from being associated with a different assembly.

As previously stated, motorized tensioning device 160 may be activated by a pressure force on sole structure or control buttons. Upon activation, motor assembly 620 may actuate gear reduction system 628. Which in turn will result in worm shaft 653 and affixed third gear 636 to rotate with respect to lateral axis 191. Rotating third gear 636, which is intermeshed with fourth gear 637, referred to collectively as worm drive 639, will then drive fourth gear 637 which in turn rotates reel shaft 654. As first reel member 640 and second reel member 642 are concentrically mounted to the reel shaft 654, the rotation of reel shaft 654 rotates first reel member 640 and second reel member 641 to wind lace 152 upon reel members 663 in response. The winding of lace 152 onto reel member 663 may be associated with a pull-in rate 195 lace 152 as described above. In one embodiment, during operation, first reel member 640 with lace 152 may have a first pull-in rate 295 while second reel member 641 with lace 152 may have a second pull-in rate 296, different from first pull-in rate. Different pull-in rates may be affected by various factors to include, but not limited to the routing of lace 152 throughout article 100, different diameter sizes of reel members 663, and gear sizes of gear reduction system 628. As previously noted, a significant reduction of speed occurs due to the relative diameter sizes of third gear 636, fourth gear 637, and reel members 663. This reduction of speed allows for better control of the winding or unwinding of lace 152 in relation to motor speed of motor assembly 620.

During operation, worm drive 639 has the characteristic of a unidirectional or one-way transmission also referred to as self-locking mechanism. As used in this detailed description and in the claims, one-way transmission refers to the feature that rotation can only be transmitted from third gear 636 to fourth gear 637. Further, the rotation cannot be transmitted from fourth gear 637 to third gear 636. In other words, third gear 636 can only drive fourth gear 637 and not the reverse. With this arrangement, lace 152 cannot be easily loosened (unwind) and will remain at the desired amount of tension.

The worm drive 639 depicted herein is only intended to be exemplary of a one-way torque transmitting mechanism that may be used to transmit torque to a reel member. Other embodiments are not limited to worm-like mechanisms and could include other one-way mechanisms. Examples of other one-way mechanisms that could be used include, but are not limited to: roller bearings, sprig clutches, ratcheting wheel and pawl as well as other mechanisms.

Referring to FIGS. 7 and 8, in different embodiments, worm shaft 653 may comprise a first end region 673 and a second end region 675. In some embodiments, first end region 673 may include threading. In some cases, the threading may engage an internally threaded cavity of third gear 636, which may facilitate the relative axial movement of fourth gear 637 along reel shaft 654. Worm shaft 653 may also include a second end region 675 that can be associated with second gear 635 in some embodiments. In some embodiments, an intermediate region 626 of worm shaft 653 may be disposed between first end region 673 and second end region 675. In one embodiment, intermediate region 626 may extend between second gear 635 and third gear 636.

Thus, various portions of worm shaft 653 and reel shaft 654 can be configured to receive components of a torque transmitting system 650. Furthermore, reel shaft 654 can be configured to receive first reel member 640 and second reel member 641 at first end portion 655 of reel shaft 654 such that reel members 663 are coaxial with reel shaft 654. In some embodiments, second end portion 666 of reel shaft 654 may be associated with rotation control assembly or worm drive 639. In some other embodiments, reel shaft 654 can be configured to receive first reel member 640 and second reel member 641 at opposite ends of reel shaft 654 such that reel members 663 are coaxial with reel shaft 654. In some embodiments, center portion 677 of reel shaft 654 may be associated with rotation control assembly or worm drive 639.

In other embodiments, alternate methods could be used for co piing a shaft and reel members. Examples include other kinds of physical interlocking features or including friction increasing features. As one example, axial compliant friction coupling could be achieved using a wave washer or Belleville washer.

In different embodiments, the location of a motorized tensioning device 160 can vary from one embodiment to another. The illustrated embodiments show a motorized tensioning device disposed on the sole structure along midfoot region 103. However, other embodiments may incorporate a motorized tensioning device in any other location of an article of footwear, including forefoot region 101 and midfoot region 103 of the sole structure. In still other embodiments, a motorized tensioning device could be disposed in or along an upper of an article. The location of a motorized tensioning device may be selected according to various factors including, but not limited to: size constraints, manufacturing constraints, aesthetic preferences, optimal lacing placement, ease of removability as well as possibly other factors.

Some embodiments may include provisions for incorporating a motorized tensioning device into removable components of an article. In one embodiment, a motorized tensioning device may be incorporated into an external sole structure casing or wrapping which may function as a harness for mounting a motorized tensioning device to an article. An example of a heel counter configured for use with a lace tensioning device is disclosed in Gerber, U.S. Pat. Number 10,004,295, now U.S. patent application Ser. No. 13/481,132, filed May 25, 2012 and titled "Article of Footwear with Protective Member for a Control Device", the entirety of which is hereby incorporated by reference.

Embodiments may include a battery and/or control unit configured to power and control motorized tensioning device 160. FIGS. 7 and 8 illustrate a schematic view of an embodiment of a battery 691, battery assembly 720, and a control unit 693. In the embodiments shown, motorized tensioning device 160, battery 691, battery assembly 720, and control unit 693 are all disposed in housing unit 412, which may function to receive and protect these components. In other embodiments, however, any of these components could be disposed in any other portions of an article, including the upper and/or sole structure.

Battery 691 is only intended as a schematic representative of one or more types of battery technologies that could be used to power motorized tightening device 160. One possibly battery technology that could be used is a lithium polymer battery. The battery (or batteries) could be rechargeable or replaceable units packaged as flat, cylindrical, or coin shaped. In addition, batteries could be single cell or cells in series or parallel.

Rechargeable batteries could be recharged in place or removed from an article for recharging. In some embodiments, charging circuitry could be built in and on board. In other embodiments, charging circuitry could be located in a remote charger. In another embodiment, inductive charging could be used for charging one or more batteries. For example, a charging antenna could be disposed in a sole structure of an article and the article could then be placed on a charging mat to recharge the batteries.

Additional provisions could be incorporated to maximize battery power and/or otherwise improve use. For example, it is also contemplated that batteries could be used in combination with super caps to handle peak current requirements. In other embodiments, energy harvesting techniques could be incorporated which utilize the weight of the runner and each step to generate power for charging a battery.

Control unit 693 is only intended as a schematic representation of one or more control technologies that could be used with motor tensioning device 160. For example, there are various approaches to motor control that may be employed to allow speed and direction control. For some embodiments, a microcontroller unit may be used. The microcontroller may use internal interrupt generated timing pulses to create pulse-width modulation (PWM) output. This PWM output is fed to an H-bridge which allows high current PWM pulses to drive the motor both clockwise and counterclockwise with speed control. However, any other methods of motor control known in the art could also be used.

A tensioning system as described above is not limited to articles of footwear and could be used with apparel, for example. As one particular example, a tensioning system could be used for adjusting a shoulder pad, worn by a user playing American football, where shoulder pads are common. However, other embodiments could use this adjustable shoulder pad configuration with any other kinds of clothing configured to be worn by players in any other sports, including, for example, hockey, lacrosse, as well as any other sports or activities requiring shoulder pads. Moreover, it should be understood that the principles discussed here can be used for adjusting any kinds of padding including, but not limited to: elbow pads, knee pads, shin pads, padding associated with the hands and arms, padding associated with the feet and legs, padding associated with the torso, padding associated with the head as well as any other kind of padding known in the art.

In still other embodiments, a tensioning system including a motorized tensioning device can be used with any other kinds of apparel and/or sports equipment including, but not limited to backpacks, hats, gloves, shirts, pants, socks, scarves, jackets, as well as other articles. Other examples of articles include, but are not limited to: shin guards, knee pads, elbow pads, shoulder pads, as well as any other type of protective equipment. Additionally, in some embodiments, the flexible manufacturing system could be used with bags, duffel bags, purses, backpacks, luggage, various kinds of sportswear and/or sporting equipment.

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

For the avoidance of doubt, the disclosure extends to the subject-matter of the following numbered paragraphs, or "Para".

Para 1. An article of footwear, comprising:

an upper;

a sole structure attached to the upper, the sole structure having a midfoot region;

a motorized tensioning device fixedly attached to the midfoot region;

the motorized tensioning device including a motor assembly coupled to a shaft member by a gear reduction system;

wherein the gear reduction system includes a first gear member intermeshed with a second gear member;

wherein the motor assembly actuates the gear reduction system when the motorized tensioning device is activated;

wherein the gear reduction system enables the first gear to transfer motion to the second gear in a first rotational direction when the motorized tensioning device is activated; and wherein the gear reduction system prevents the second gear from transferring motion to the first gear.

Para 2. An article of footwear according to Para 1, wherein the first gear member and the second gear member comprise a worm drive.

Para 3. An article of footwear according to Para 1 or 2, wherein the shaft member has a first end portion, a center portion, and a second end portion, wherein the first reel member is concentrically mounted at the first end portion, wherein the second reel member is concentrically mounted at the second end portion, and wherein the first gear and the second gear are positioned at the center portion.

Para 4. An article of footwear according to Para 3, wherein the motorized tensioning device includes a first lace member secured to the first reel member, and a second lace member secured to the second reel member.

Para 5. An article of footwear according to Para 4, wherein the first lace member winds upon the first reel member, and the second lace member winds upon the second reel member when the shaft member is rotated by the motor assembly.

Para 6. An article of footwear according to Para 5, wherein the first reel member has a first diameter, and the second reel member has a second diameter; and wherein the first diameter is different than the second diameter.

Para 7. An article of footwear according to any preceding Para, wherein the motorized tensioning device includes a housing unit, a battery and a control unit; and wherein the motor assembly is disposed between the battery and the control unit within the housing unit along a longitudinal axis.

Para 8. An article of footwear, comprising:

an upper;

a sole structure attached to the upper, the sole structure having a midfoot region;

a motorized tensioning device fixedly attached to the midfoot region;

the motorized tensioning device including a first reel member and a first lace member attached to the first reel member and the motorized tensioning device including a second reel member and a second lace member attached to the second reel member;

wherein the first lace member and the second lace member are routed from the first reel member and the second reel member through sidewall portions disposed on a medial side and a lateral side of the upper such that portions of the first lace member and the second lace member are arranged in a parallel configuration on a tongue of the upper;

wherein the motorized tensioning device is activated by a pressure force applied on the sole structure;

wherein a first portion of the first lace member extends through a first region of the upper and wherein the first region of the upper is adjusted when the motorized tensioning device is activated;

wherein a second portion of the second lace member extends through a second region of the upper and wherein the second region of the upper is adjusted when the motorized tensioning device is activated; and wherein the first region is different from the second region.

Para 9. An article of footwear according to Para 8, wherein the motorized tensioning device includes a gear reduction system, wherein the gear reduction system includes a first gear member intermeshed with a second gear member.

Para 10. An article of footwear according to Para 9, wherein the motorized tensioning device includes a shaft member, the shaft member has a first end portion, a center portion, and a second end portion, wherein the first reel member is concentrically mounted at the first end portion, wherein the second reel member is concentrically mounted at the second end portion, and wherein the first gear and the second gear are positioned at the center portion.

Para 11. An article of footwear according to Para 10, wherein the motorized tensioning device includes a housing unit, wherein the first end portion of the shaft member is attached to the housing unit.

Para 12. An article of footwear according to Para 6, wherein the first lace member is further routed through a first medial internal channel, a first lateral internal channel, a second lateral Internal channel, and a second medial internal channel;

wherein the first medial internal channel and the second medial internal channel are adjacent to one another; and wherein the first lateral internal channel and the second lateral internal channel are adjacent to one another.

Para 13. An article of footwear according to any of Paras 8 to 12, wherein the first lace member is further routed through a first medial internal channel, a first lateral internal channel, a third lateral internal channel, and a third medial internal channel;

wherein a second medial internal channel is disposed between the first medial internal channel and the third medial internal channel; and wherein a second lateral internal channel is disposed between the first lateral internal channel and the third lateral internal channel.

Para 14. An article of footwear, comprising:

an upper;

a sole structure attached to the upper, the sole structure having a midfoot region;

a motorized tensioning device fixedly attached to the midfoot region; the motorized tensioning device including a first lace member and a second lace member;

wherein the first lace member includes a first tensioning portion and a second tensioning portion;

wherein the second lace member includes a third tensioning portion and a fourth tensioning portion;

wherein the first tensioning portion and the second tensioning portion are associated with a first amount of tension;

wherein the third tensioning portion and the fourth tensioning portion are associated with a second amount of tension; and wherein the first amount of tension is different than the second amount of tension.

Para 15. An article of footwear according to Para 14, wherein the first gear member and the second gear member comprise a worm drive.

Para 16. An article of footwear according to Para 15, wherein the motorized tensioning device includes a shaft member, the shaft member has a first end portion, a center portion, and a second end portion, a first reel member is concentrically mounted at the first end portion, a second reel member is concentrically mounted at the second end portion, and wherein the first gear and the second gear are positioned at the center portion.

Para 17. An article of footwear according to Para 16, wherein the first lace member and the second lace member are routed from the first reel member and the second reel member through sidewall portions disposed on a medial side and a lateral side of the upper such that portions of the first lace member, and the second lace member are arranged in a parallel configuration on a tongue of the upper.

Para 18. An article of footwear according to Para 17, wherein the first lace member is further routed through a first medial internal channel, a first lateral internal channel, a second lateral internal channel, and a second medial internal channel;

wherein the first medial internal channel and the second medal internal channel are adjacent; and wherein the first lateral internal channel and the second lateral internal channel are adjacent.

Para 19. An article of footwear according to Para 17, wherein the first lace member is further routed through a first medial internal channel, a first lateral internal channel, a third lateral internal channel, and a third medial internal channel;

wherein a second medial internal channel is disposed between the first medial internal channel and the third medial internal channel; and wherein a second lateral internal channel is disposed between the first lateral internal channel and the third lateral internal channel.

Para 20. An article of footwear according to any of Paras 14 to 19, wherein the motorized tensioning device includes a motor assembly, housing unit, a battery and a control unit; and wherein the motor assembly is disposed between the battery and the control unit within the housing unit.

What is claimed is:

1. An article of footwear, comprising:

an upper;

a sole structure attached to the upper, the sole structure having a midfoot region;

a motorized tensioning device fixedly attached to the midfoot region;

the motorized tensioning device including a motor assembly coupled to a shaft member by a gear reduction system;

wherein the gear reduction system includes a first gear member intermeshed with a second clear member;

wherein the motor assembly actuates the gear reduction system when the motorized tensioning device is activated;

wherein the gear reduction system enables the first gear to transfer motion to the second gear in a first rotational direction when the motorized tensioning device is activated; and wherein the gear reduction system prevents the second gear from transferring motion to the first gear.

2. The article of footwear according to claim 1, wherein the first gear member and the second gear member comprise a worm drive.

3. The article of footwear according to claim 1, wherein the shaft member has a first end portion, a center portion, and a second end portion, wherein the first reel member is concentrically mounted at the first end portion, wherein the second reel member is concentrically mounted at the second end portion, and wherein the first gear and the second gear are positioned at the center portion.

4. The article of footwear according to claim 3, wherein the motorized tensioning device includes a first lace member secured to the first reel member, and a second lace member secured to the second reel member.

5. The article of footwear according to claim 4, wherein the first lace member winds upon the first reel member, and the second lace member winds upon the second reel member when the shaft member is rotated by the motor assembly.

6. The article of footwear according to claim 5, wherein the first reel member has a first diameter, and the second reel member has a second diameter; and wherein the first diameter is different than the second diameter.

7. The article of footwear according to claim 1, wherein the motorized tensioning device includes a housing unit, a battery and a control unit; and wherein the motor assembly is disposed between the battery and the control unit within the housing unit along a longitudinal axis.

8. An article of footwear, comprising:

an upper;

a sole structure attached to the upper, the sole structure having a midfoot region;

a motorized tensioning device fixedly attached to the midfoot region;

the motorized tensioning device including a first reel member and a first lace member attached to the first reel member and the motorized tensioning device including a second reel member and a second lace member attached to the second reel member;

wherein the first lace member and the second lace member are routed from the first reel member and the second reel member through sidewall portions disposed on a medial side and a lateral side of the upper such that portions of the first lace member and the second lace member are arranged in a parallel configuration on a tongue of the upper;

wherein the motorized tensioning device is activated by a pressure force applied on the sole structure;

wherein a first portion of the first lace member extends through a first region of the upper and wherein the first region of the upper is adjusted when the motorized tensioning device is activated;

wherein a second portion of the second lace member extends through a second region of the upper and wherein the second region of the upper is adjusted when the motorized tensioning device is activated; and wherein the first region is different from the second region.

9. The article of footwear according to claim 8, wherein the motorized tensioning device includes a gear reduction system, wherein the gear reduction system includes a first gear member intermeshed with a second gear member.

10. The article of footwear according to claim 9, wherein the motorized tensioning device includes a shaft member, the shaft member has a first end portion, a center portion, and a second end portion, wherein the first reel member is concentrically mounted at the first end portion, wherein the second reel member is concentrically mounted at the second end portion, and wherein the first gear, and the second gear are positioned at the center portion.

11. The article of footwear according to claim 10, wherein the motorized tensioning device includes a housing unit, wherein the first end portion of the shaft member is attached to the housing unit.

12. The article of footwear according to claim 8, wherein the first lace member is further routed through a first medial internal channel, a first lateral internal channel, a second lateral internal channel, and a second medial internal channel;

wherein the first medial internal channel and the second medial internal channel are adjacent to one another; and wherein the first lateral internal channel and the second lateral internal channel are adjacent to one another.

13. The article of footwear according to claim 8, wherein the first lace member is further routed through a first medial internal channel, a first lateral internal channel, a third lateral internal channel, and a third medial internal channel;

wherein a second medial internal channel is disposed between the first medial internal channel and the third medial internal channel; and wherein a second lateral internal channel is disposed between the first lateral internal channel and the third lateral internal channel.

14. An article of footwear, comprising:

an upper;

a sole structure attached to the upper, the sole structure having a midfoot region;

a motorized tensioning device fixedly attached to the midfoot region;

the motorized tensioning device including a first lace member and a second lace member;

wherein the first lace member includes a first tensioning portion and a second tensioning portion;

wherein the second lace member includes a third tensioning portion and a fourth tensioning portion;

wherein the motorized tensioning device is configured to cause the first tensioning portion and the second tensioning portion to have a first amount of tension; and wherein the motorized tensioning device is configured to cause the third tensioning portion and the fourth tensioning portion to have a second amount of tension different than the first amount of tension, wherein the first gear member and the second gear member comprise a worm drive; and wherein the motorized tensioning device includes a shaft member, the shaft member has a first end portion, a center portion, and a second end portion, a first reel member is concentrically mounted at the first end portion, a second reel member is concentrically mounted at the second end portion, and wherein the first gear and the second gear are positioned at the center portion.

15. The article of footwear according to claim 14, wherein the first lace member and the second lace member are routed from the first reel member and the second reel member through sidewall portions disposed on a medial side and a lateral side of the upper such that portions of the first lace member, and the second lace member are arranged in a parallel configuration on a tongue of the upper.

16. The article of footwear according to claim 15, wherein the first lace member is further routed through a first medial internal channel, a first lateral internal channel, a second lateral internal channel, and a second medial internal channel;

wherein the first medial internal channel and the second medial internal channel are adjacent; and wherein the first lateral internal channel and the second lateral internal channel are adjacent.

17. The article of footwear according to claim 15, wherein the first lace member is further routed through a first medial internal channel, a first lateral internal channel, a third lateral internal channel, and a third medial internal channel;

wherein a second medial internal channel is disposed between the first medial internal channel and the third medial internal channel; and wherein a second lateral internal channel is disposed between the; lateral internal channel and the third lateral internal channel.

18. The article of footwear according to claim 14, wherein the motorized tensioning device includes a motor assembly, housing unit, a battery and a control unit; and wherein the motor assembly is disposed between the battery and the control unit within the housing unit.

* * * * *